US012522892B2

(12) United States Patent
Tsukamoto et al.

(10) Patent No.: US 12,522,892 B2
(45) Date of Patent: Jan. 13, 2026

(54) TITANIUM ALLOY SHEET AND METHOD FOR MANUFACTURING TITANIUM ALLOY SHEET

(71) Applicant: NIPPON STEEL CORPORATION, Tokyo (JP)

(72) Inventors: Genki Tsukamoto, Tokyo (JP); Tomonori Kunieda, Tokyo (JP); Yoshiki Koike, Tokyo (JP); Toshiyuki Okui, Tokyo (JP); Hidenori Takebe, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 442 days.

(21) Appl. No.: 18/038,038

(22) PCT Filed: Jan. 28, 2021

(86) PCT No.: PCT/JP2021/002959
§ 371 (c)(1),
(2) Date: May 22, 2023

(87) PCT Pub. No.: WO2022/162814
PCT Pub. Date: Aug. 4, 2022

(65) Prior Publication Data
US 2024/0002981 A1 Jan. 4, 2024

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00; C22F 1/183
See application file for complete search history.

(56) References Cited

U.S. PATENT DOCUMENTS

2013/0327448 A1 12/2013 Kawakami et al.
2013/0327449 A1 12/2013 Kawakami et al.
2015/0292650 A1 10/2015 Kawakami et al.
2016/0326620 A1 11/2016 Kawakami et al.
2017/0014882 A1 1/2017 Kawakami et al.

FOREIGN PATENT DOCUMENTS

| | | | | |
|---|---|---|---|---|
| JP | S61-147864 | A | 7/1986 | |
| JP | H01-127653 | A | 5/1989 | |
| JP | H07-62474 | A | 3/1995 | |
| JP | H07-70676 | A | 3/1995 | |
| JP | 2001-300603 | A | 10/2001 | |
| JP | 2001-300604 | A | 10/2001 | |
| JP | 2013-227618 | A | 11/2013 | |
| WO | 2012/115242 | A1 | 8/2012 | |
| WO | 2012/115243 | A1 | 8/2012 | |
| WO | 2015/156356 | A1 | 10/2015 | |
| WO | WO-2020213719 | A1 * | 10/2020 | ..... C25D 17/10 |

OTHER PUBLICATIONS

English Abstract and English Machine Translation of Kuneida et al. (WO 2020/213719 A1) (Oct. 22, 2020).*
Itsumi et al., "Coilable High Strength α-β Type Titanium Alloy, KS Ti-9, with Properties Comparable to Ti—6Al—4V", Kobe Steel Engineering Reports, Apr. 2009, pp. 81-84, vol. 59, No. 1, with English abstract.
Tsumi et al., "Process for Hot Rolling KS Ti-9 Coiled Sheet for Less In-Plane Anisotropy in Strength and Bendability", Kobe Steel Engineering Reports, Aug. 2010, pp. 50-54, vol. 60, No. 2, with English abstract.

* cited by examiner

*Primary Examiner* — Jessee R Roe
(74) *Attorney, Agent, or Firm* — Myers Wolin, LLC

(57) ABSTRACT

A titanium alloy thin sheet contains specific chemical components, in which, when a crystal orientation of an α-phase is expressed by an Euler angle g={φ1, ϕ, φ2} according to Bunge's notation method, the orientation with maximum intensity expressed by a crystal orientation distribution function f(g) calculated with Series Rank of 16 and a Gaussian half width of 5° in texture analysis using a spherical harmonics method of an electron backscatter diffraction method is in the range of φ1: 0 to 30°, ϕ: 60 to 90°, and φ2: 0 to 60°, and a degree of accumulation of the orientation with maximum intensity is 10.0 or more, a 0.2% proof stress in a sheet width direction at 25° C. is 800 MPa or more, a Young's modulus in the sheet width direction is 125 GPa or more, and an average sheet thickness is 2.5 mm or less.

10 Claims, 4 Drawing Sheets

TITANIUM ALLOY SHEET AND METHOD FOR MANUFACTURING TITANIUM ALLOY SHEET

CROSS-REFERENCE TO RELATED APPLICATION

This application is a National Phase under 35 U.S.C. 371 of PCT/JP2021/002959, filed on Jan. 28, 2021, and designated the U.S., the contents of which are wholly incorporated herein by reference.

TECHNICAL FIELD

The present disclosure relates to a titanium alloy sheet and a method for manufacturing a titanium alloy sheet.

BACKGROUND ART

Titanium is a material that is lightweight and has high strength and excellent corrosion resistance, and a material that can be applied to the field of aircrafts from the viewpoint of reduction in weight and improvement in fuel efficiency. Titanium alloys have been actively developed in accordance with characteristics required for each of constituent members of aircrafts.

For example, Patent Document 1 discloses an α+β type titanium alloy wire rod containing 1.4% or more and less than 2.1% Fe, 4.4% or more and less than 5.5% Al, and a remainder of titanium and impurities.

Patent Document 2 discloses an α+β type titanium alloy bar containing 0.5% or more and less than 1.4% Fe, 4.4% or more and less than 5.5% Al, and a remainder of titanium and impurities.

Patent Document 3 discloses a method for manufacturing a Ti-6Al-4V alloy sheet by pack rolling characterized in that, in a method for manufacturing a sheet in which a pack material is formed by covering one or a plurality of sheet-shaped core materials with spacer materials and cover materials and the pack material is rolled to reduce thicknesses of the core materials, initial sheet thicknesses of each material are set by setting sheet thicknesses of the cover materials such that the ratio of the core materials to the pack material is at least 0.25 or more.

Patent Document 4 discloses a method for manufacturing a Ti-6Al-4V alloy sheet by pack rolling characterized in that, in a method for manufacturing a sheet in which a pack material is formed by covering one or a plurality of sheet-shaped core materials with spacer materials and cover materials, and the pack material is rolled to reduce thicknesses of the core materials, a rolling reduction per pass is set to 15% or more for rolling in which the sheet thickness reduction ratio between before and after pressure reduction of the pack material is 3 or more.

Patent Document 5 discloses a method for manufacturing a titanium alloy sheet characterized in that a hot-rolled and annealed titanium alloy sheet containing, in % by weight, Al: 2.5 to 3.5%, V: 2.0 to 3.0%, and a remainder of Ti and ordinary impurities is cold-rolled in the same direction as the hot rolling direction at a total rolling reduction of 67% or more, and then annealed at a temperature between 650 to 900° C.

Patent Document 6 discloses a method for manufacturing an α+β type titanium alloy sheet characterized by performing intermediate annealing after cold rolling in a manufacturing process of an α+β type titanium alloy cold-rolled sheet under the conditions of an annealing temperature: a temperature range of [β transformation point-25° C.] or higher and lower than the β transformation point, an annealing time: 0.5 to 4 hours, a cooling rate after heating and holding: 0.5 to 5° C./sec, and a temperature range for cooling at the above cooling rate: 300° C. or lower.

Patent Document 7 discloses an α+β type titanium alloy sheet characterized by containing at least one complete solid-solution type β-stabilizing element at 2.0 to 4.5% by mass in Mo equivalent, at least one eutectoid-type β-stabilizing element at 0.3 to 2.0% by mass in Fe equivalent, at least one α-stabilizing element at more than 3.0% by mass and 5.5% by mass or less in Al equivalent, and a remainder of Ti and unavoidable impurities, in which the average grain size of an α-phase is 5.0 μm or less, the maximum grain size of the α-phase is 10.0 μm or less, the average aspect ratio of the α-phase is 2.0 or less, and the maximum aspect ratio of the α-phase is 5.0 or less.

Patent Document 8 discloses an α+β type titanium alloy sheet having excellent cold rolling properties and cold handling properties characterized in that an α+β type titanium alloy hot-rolled sheet is formed such that, when (a) the normal direction (a sheet thickness direction) of a rolled surface of a hot-rolled sheet is defined as ND, the hot rolling direction is defined as RD, a width direction of the hot-rolled sheet is defined as TD, the normal direction of a (0001) plane of an α-phase is defined as c axis orientation, an angle formed between the c axis orientation and ND is defined as θ, and an angle formed between a surface including the c axis orientation and ND and a surface including ND and TD is defined as Φ, (b1) the strongest intensity among (0002) reflection relative intensities of X-rays of crystal grains in which θ is 0 degrees or more and 30 degrees or less and Φ falls within the entire circumference (−180 degrees to 180 degrees) is defined as XND, and (b2) the strongest intensity among (0002) reflection relative intensities of X-rays of crystal grains in which θ is 80 degrees or more and less than 100 degrees and Φ falls within ±10 degrees is defined as XTD, (c) XTD/XND is 5.0 or more.

Patent Document 9 discloses a high-strength α+β type titanium alloy sheet having excellent cold coil handling properties characterized in that a high-strength α+β type titanium alloy hot-rolled sheet containing, in % by mass, Fe: 0.8 to 1.5%, Al: 4.8 to 5.5%, N: 0.030% or less, O and N in the range in which Q satisfies Q (%)=0.14 to 0.38, which is defined by Q (%)=[O]+2.77. [N] when the O content (% by mass) is defined as [O] and the N content (% by mass) is defined as [N], and a remainder of Ti and unavoidable impurities is formed such that, when (a) the normal direction of a hot-rolled sheet is defined as ND, the hot rolling direction is defined as RD, a width direction of the hot-rolled sheet is defined as TD, the normal direction of a (0001) plane of an α-phase is defined as c axis orientation, an angle formed between the c axis orientation and ND is defined as θ, and an angle formed between a surface including the c axis orientation and ND and a surface including ND and TD is defined as φ, (b1) the strongest intensity among (0002) reflection relative intensities of X-rays of crystal grains in which θ is 0 degrees or more and 30 degrees or less and φ falls within the entire circumference (−180 degrees to 180 degrees) is defined as XND, and (b2) the strongest intensity among (0002) reflection relative intensities of X-rays of crystal grains in which θ is 80 degrees or more and less than 100 degrees and φ falls within ±10 degrees is defined as XTD. (c) XTD/XND is 4.0 or more.

Patent Document 10 discloses an α+β titanium alloy sheet having high strength in a sheet width direction and a high Young's modulus characterized in that, in a high-strength α+β type titanium alloy cold-rolled annealed sheet containing, in % by mass, 0.8 to 1.5% Fe, 0.020% or less N, O, N, and Fe in the range in which Q (%) satisfies Q=0.34 to 0.55, which is defined by Q (%)=[O]+2.77×[N]+0.1×[Fe] when the O content (% by mass) is defined as [O], the N content (% by mass) is defined as [N], and the Fe content (% by mass) is defined as [Fe], and a remainder of Ti and unavoidable impurities, when a texture in a sheet surface direction is analyzed, in a case in which the normal direction of a rolled surface of a cold-rolled annealed sheet is defined as ND, a sheet longitudinal direction is defined as RD, a sheet width direction is defined as TD, the normal direction of a (0001) plane of an α-phase is defined as c axis orientation, an angle formed between the c axis orientation and ND is defined as θ, an angle formed between a projection line of the c axis orientation to the sheet surface and the sheet width direction (TD) is defined as φ, the strongest intensity among (0002) reflection relative intensities of X-rays of crystal grains in which the angel θ is 0 degrees or more and 30 degrees or less and φ falls within −180 degrees to 180 degrees is defined as XND, and the strongest intensity among (0002) reflection relative intensities of X-rays of crystal grains in which the angle θ is 80 degrees or more and less than 100 degrees and φ falls within the range of ±10 degrees is defined as XTD, the ratio XTD/XND is 5.0 or more.

Non-Patent Document 1 discloses an α+β titanium alloy sheet having anisotropy in strength in a rolling direction and in a direction perpendicular to the rolling direction.

Non-Patent Document 2 discloses an α+β titanium alloy sheet obtained by hot rolling at a temperature higher than a B transformation point to reduce anisotropy of strength in a rolling direction and in a direction perpendicular to the rolling direction.

CITATION LIST

Patent Document

Patent Document 1

Japanese Unexamined Patent Application, First Publication No. H07-62474

Patent Document 2

Japanese Unexamined Patent Application, First Publication No. H07-70676

Patent Document 3

Japanese Unexamined Patent Application, First Publication No. 2001-300603

Patent Document 4

Japanese Unexamined Patent Application, First Publication No. 2001-300604

Patent Document 5

Japanese Unexamined Patent Application, First Publication No. S61-147864

Patent Document 6

Japanese Unexamined Patent Application, First Publication No. H01-127653

Patent Document 7

Japanese Unexamined Patent Application, First Publication No. 2013-227618

Patent Document 8

PCT International Publication No. WO 2012/115242

Patent Document 9

PCT International Publication No. WO 2012/115243

Patent Document 10

PCT International Publication No. WO 2015/156356

Non-Patent Document

Non-Patent Document 1

KOBE STEEL ENGINEERING REPORTS/Vol. 59, No. 1 (2009), p. 81-84

Non-Patent Document 2

KOBE STEEL ENGINEERING REPORTS/Vol. 60, No. 2 (2010), p. 50-54

SUMMARY

Problems to be Solved

Incidentally, for members requiring higher strength among constituent elements of aircrafts, alloys containing a relatively large amount of Al, which is an α-phase solid-solution strengthening element, such as an α+β type titanium alloy Ti-6Al-4V (a 64 alloy) are often used. It has been thought that an α+β type titanium alloy containing a large amount of Al and having high strength, such as the 64 alloy, generally has poor workability and is difficult to be cold-rolled.

On the other hand, when a titanium alloy is subjected to high speed hot rolling in one direction at a temperature in a β region or in an α+β high temperature region with a high proportion of a β-phase, a texture (T-texture) in which a c axis of a hexagonal close-packed (hcp) structure is oriented in a sheet width direction by variant selection is formed during transformation from the β-phase to the α-phase. Since a c axis direction of titanium has a higher Young's modulus and strength than other directions, the T-texture is a texture suitable for increasing strength in the sheet width direction and increasing a Young's modulus. However, in the case of manufacturing a thin titanium alloy sheet by hot rolling, a temperature of a material during hot rolling drops sharply due to reduction in sheet thickness, and thus a titanium alloy in which an α-phase having high strength increases and a β-phase having low strength at high temperature decreases has significantly increased deformation resistance, which may result in exceeding an allowable load of a rolling mill. For that reason, it is difficult to manufacture a sheet having a thickness of 2.5 mm or less only by hot rolling. In addition, in a case in which a recrystallized texture is formed by high temperature annealing for the purpose of softening of work hardening in cold rolling, the present texture disappears easily. For this reason, in known techniques, the present texture has not been effectively utilized for sheets having a sheet thickness of 2.5 mm or less. For these reasons, in known techniques, it has been considered that it is difficult to manufacture a titanium alloy sheet containing a large amount of Al and having high strength and a high Young's modulus with a developed T-texture.

The present disclosure has been made in view of the above problems, and an object of the present disclosure is to provide an Al-containing titanium alloy sheet having a thickness of 2.5 mm or less, which has high strength in a sheet width direction and a high Young's modulus in the sheet width direction by utilizing a T-texture and a method for manufacturing the same titanium alloy sheet.

Means for Solving the Problem

Originally, since a T-texture in titanium having a hcp structure is expected to be deformed due to a slip in a hot rolling direction, it cannot be concluded that cold rolling in the same direction is difficult. The present inventors have made intensive and detailed studies on manufacturing a sheet having a thickness of 2.5 mm or less by cold rolling using an Al-containing titanium alloy having a T-texture developed by hot rolling.

The present disclosure has been completed on the basis of the above findings, and the gist thereof is as follows.

[1] A titanium alloy sheet according to an aspect of the present disclosure contains, in % by mass, Al: more than 4.0% and 6.6% or less, Fe: 0% or more and 2.3% or less, V: 0% or more and 4.5% or less, Si: 0% or more and 0.60% or less, Ni: 0% or more and less than 0.15%, Cr: 0% or more and less than 0.25%. Mn: 0% or more and less than 0.25%, C: 0% or more and less than 0.080%, N: 0% or more and 0.050% or less, O: 0% or more and 0.40% or less, and a remainder of Ti and impurities, in which, in a case in which a crystal orientation of an α-phase is expressed by an Euler angle g={φ1, Φ, φ2} according to Bunge's notation method, the orientation with maximum intensity indicated by a crystal orientation distribution function f(g) calculated with Series Rank of 16 and a Gaussian half width of 5° in texture analysis using a spherical harmonics method of an electron backscatter diffraction method is in the range of φ1: 0 to 30°, Φ: 60 to 90°, and φ2: 0 to 60°, and a degree of accumulation of the orientation with maximum intensity is 10.0 or more, a 0.2% proof stress in a sheet width direction at 25° C. is 800 MPa or more, a Young's modulus in the sheet width direction is 125 GPa or more, and an average sheet thickness is 2.5 mm or less.

[2] The titanium alloy sheet described in the above [1] may contain, in % by mass, either Fe: 0.5% or more and 2.3% or less or V: 2.5% or more and 4.5% or less.

[3] The titanium alloy sheet described in the above [2], may contain, in % by mass, one element or two or more elements selected from the group including Ni: less than 0.15%, Cr: less than 0.25%, and Mn: less than 0.25% in place of a part of the Fe or the V.

[4] The titanium alloy sheet according to the above [2] or [3], in which, in a case in which one element or two or more elements selected from the group including O, N, Fe, and V are contained in place of a part of the Ti, when the O content, in % by mass, is defined as [O], the N content is defined as [N], the Fe content is defined as [Fe], and the V content is defined as [V], Q expressed by the following formula (1) may be 0.340 or less.

$$Q=[O]+(2.77\times[N])+(0.1\times[Fe])+(0.025\times[V]) \quad \text{Formula (1)}$$

[5] The titanium alloy sheet according to any one of the above [1] to [4], in which a half width of a diffraction peak at 2θ=53.3±1° detected by an X-ray diffraction method using CuKα as a radiation source may be 0.20° or more.

[6] The titanium alloy sheet according to any one of the above [1] to [5] may have band structures having an aspect ratio of more than 3.0 and elongated in a sheet longitudinal direction, in which an area fraction of the band structures may be 70% or more.

[7] The titanium alloy sheet according to any one of the above [1] to [6], in which a dimensional accuracy of a sheet thickness thereof may be 5.0% or less with respect to the average sheet thickness.

[8] A method for manufacturing a titanium alloy sheet according to another aspect of the present disclosure is a method for manufacturing the titanium alloy sheet according to any one of the above [1] to [7], including:

heating a titanium material containing, in % by mass, Al: more than 4.0% and 6.6% or less, Fe: 0% or more and 2.3% or less, V: 0% or more and 4.5% or less, Si: 0% or more and 0.60% or less, Ni: 0% or more and less than 0.15%, Cr: 0% or more and less than 0.25%, Mn: 0% or more and less than 0.25%, C: 0% or more and less than 0.08%, N: 0% or more and 0.05% or less, O: 0% or more and 0.40% or less, and a remainder of Ti and impurities;

hot rolling the titanium material in one direction after the heating; and performing one or more cold rolling passes on the titanium material after the hot rolling in a longitudinal direction of the titanium material, in which, when a β transformation point is defined as $T_\beta$ (° C.), a beating temperature of the titanium material in the heating is $T_\beta$° C. or higher and ($T_\beta$+150)° C. or lower, a rolling reduction in the hot rolling is 80.0% or more, a finishing temperature in the hot rolling is ($T_\beta$−250)° C. or higher and ($T_\beta$−50)° C. or lower, in the cold rolling, a rolling reduction per cold rolling pass is 40% or less, and in the case of performing a plurality of cold rolling passes, intermediate annealing treatment is included, in annealing conditions for the intermediate annealing treatment, an annealing temperature is 500° C. or higher and 750° C. or lower, and the annealing temperature T (° C.) and a holding time t (seconds) at the annealing temperature satisfy the following formula (2).

$$18000\leq(T+273.15)\times(\mathrm{Log}_{10}(t)+20)<22000 \quad \text{Formula (2)}$$

[9] The method for manufacturing the titanium alloy sheet described in the above [8], in which, after the final cold rolling pass, final annealing in which the annealing temperature is 500° C. or higher and 750° C. or lower and which satisfies the above formula (2) may be performed.

Effects

According to the present disclosure, it is possible to provide an Al-containing titanium alloy sheet that has high strength in the sheet width direction, a high Young's modulus in the sheet width direction, and a thickness of 2.5 mm or less by utilizing the T-texture and the method for manufacturing the same titanium alloy sheet.

DETAILED DESCRIPTION

1. Titanium Alloy Sheet

Figure 1:
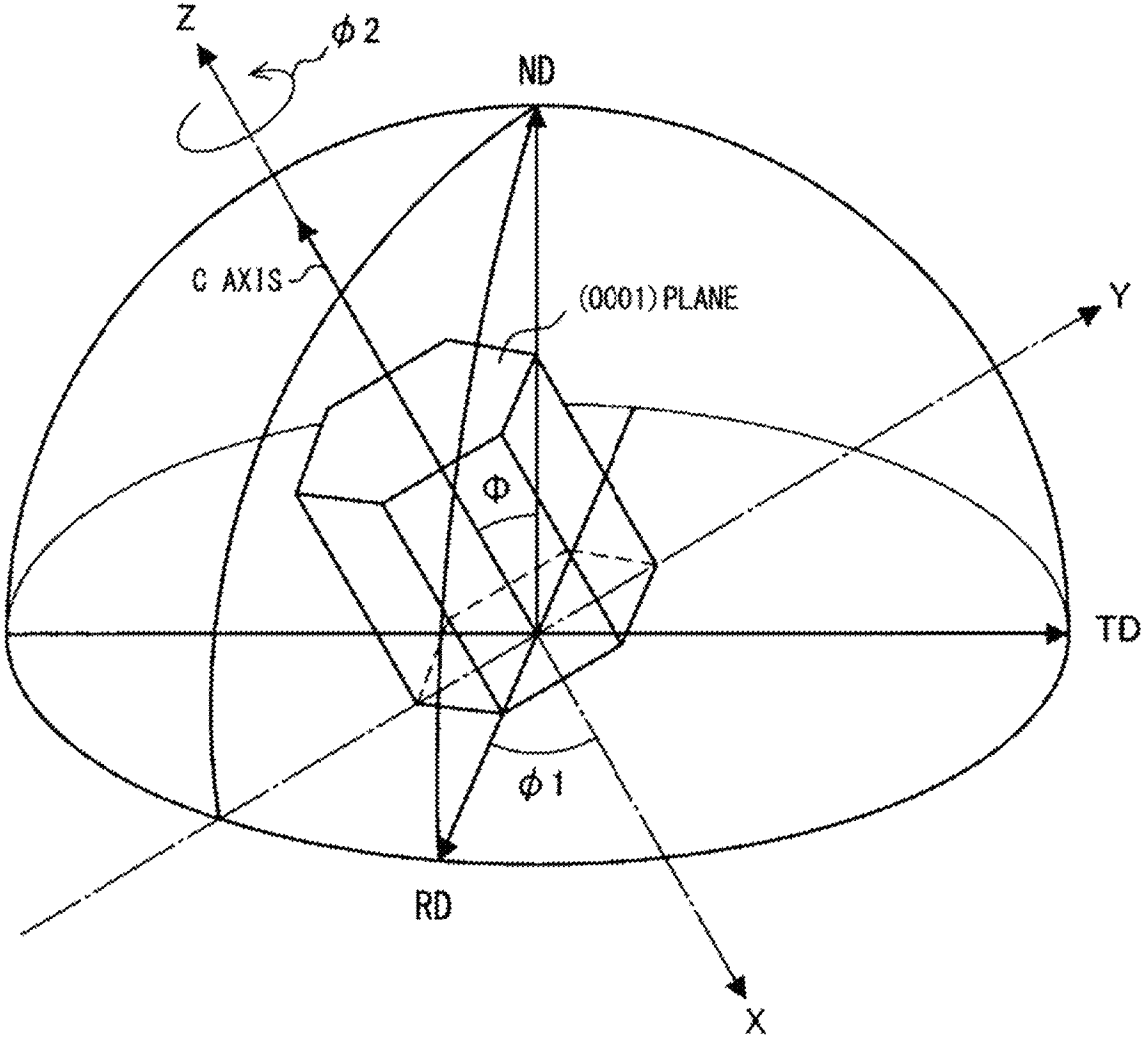
FIG. 1 is an explanatory diagram showing a crystal orientation of an α-phase crystal grain of a titanium sheet by an Euler angle according to Bunge's notation method.

First, a titanium alloy sheet according to the present embodiment will be described with reference to the drawings.

1.1. Chemical Composition

Chemical components contained in the titanium alloy sheet according to the present embodiment will be described. The titanium alloy sheet according to the present embodiment contains, in % by mass, Al: more than 4.0% and 6.6% or less, Fe: 0% or more and 2.3% or less, V: 0% or more and 4.5% or less. Si: 0% or more and 0.60% or less, Ni: 0% or more and less than 0.15%, Cr: 0% or more and less than 0.25%, Mn: 0% or more and less than 0.25%, C: 0% or more and less than 0.08%, N: 0% or more and 0.05% or less. O: 0% or more and 0.40% or less, and a remainder of Ti and impurities. Also, hereinafter, in the description of the chemical components, the notation "%" represents "% by mass" unless otherwise specified.

Al is an α-phase stabilizing element and an element with high solid-solution strengthening ability. When the Al content increases, tensile strength at room temperature and strength at a relatively high temperature increases. In addition, Al has the effect of increasing a Young's modulus. Further, if the Al content is more than 4.0%, a hot-rolled sheet before cold rolling can maintain high cold rolling properties. The Al content is preferably 4.5% or more. On the other hand, if the Al content is more than 6.6%, the cold rolling properties of the hot-rolled sheet before cold rolling is significantly reduced, and Al is locally excessively concentrated due to solidification segregation or the like, and thus Al is ordered. This Al-ordered region reduces impact toughness of the titanium alloy sheet. Accordingly, the Al content is 6.6% or less, preferably 6.5% or less or 6.3% or less, and more preferably 6.2% or less.

Fe is a β-phase stabilizing element. Fe is an element with high solid-solution strengthening ability, and thus when the Fe content increases, tensile strength at room temperature increases. In addition, a β-phase has higher workability than an α-phase, and thus when the Fe content increases, workability of the titanium alloy sheet improves. In order to obtain a desired tensile strength while maintaining the β-phase having good workability at room temperature, the Fe content is preferably 0.5% or more. Since Fe is not essential in the titanium alloy sheet, the lower limit of its content is 0%. The Fe content is more preferably 0.7% or more. On the other hand, Fe is an element that is very prone to solidification segregation, and thus, when Fe is excessively contained, Fe segregates locally, which may cause variations in properties between a portion in which Fe is segregated and a portion in which Fe is not segregated. Further, when Fe is excessively contained in the titanium alloy sheet, fatigue strength may be lowered. Accordingly, the Fe content is preferably 2.3% or less. The Fe content is more preferably 2.1% or less, and still more preferably 2.0% or less. Also, Fe is less expensive than β-phase stabilizing elements such as V or Si.

Fe that may be contained in the titanium alloy sheet according to the present embodiment may be replaced with V. V is a complete solid-solution type β-phase stabilizing element and an element with solid-solution strengthening ability. In order to obtain solid-solution strengthening ability equivalent to that of Fe described above, the V content is preferably 2.5% or more. The V content is more preferably 3.0% or more. Since V is not essential in the titanium alloy sheet, the lower limit of the amount thereof is 0%. Replacing Fe with V increases costs, but since V is less likely to segregate than Fe, variations in properties due to segregation are inhibited. As a result, it becomes easier to obtain stable properties in a sheet longitudinal direction and a sheet width direction of the titanium alloy sheet. In order to inhibit variations in properties due to V segregation, the V content is preferably 4.5% or less. Also, as described above, since V is less likely to segregate than Fe, V is preferably contained in a titanium material in the case of manufacturing a large ingot.

Although Si is a β-phase stabilizing element, it also dissolves in the α-phase and exhibits high solid-solution strengthening ability. As described above, Fe may segregate when the titanium alloy sheet contains more than 2.3% of Fe, and thus the titanium alloy sheet may be strengthened by containing Si, if necessary. In addition, Si has a segregation tendency opposite to that of O described below, and is less likely to solidify and segregate than O, and thus, by containing appropriate amounts of Si and O in the titanium alloy sheet, it can be expected to achieve both high fatigue strength and tensile strength. On the other hand, when the Si content is high, an intermetallic compound of Si called a silicide is formed, which may reduce fatigue strength of the titanium alloy sheet. If the Si content is 0.60% or less, generation of a coarse silicide is inhibited, and a decrease in fatigue strength is inhibited. Accordingly, the Si content is preferably 0.60% or less. The Si content is preferably 0.50% or less, more preferably 0.40% or less, and still more preferably 0.30% or less. Since Si is not essential in the titanium alloy sheet, the lower limit of the amount thereof is 0%, but the Si content may be, for example, 0.10% or more, or may be 0.15% or more.

Similarly to Fe or V. Ni is an element that improves tensile strength and workability. However, when the Ni content is 0.15% or more, an intermetallic compound $Ti_2Ni$, which is an equilibrium phase, is generated, which may deteriorate fatigue strength and room temperature ductility of the titanium alloy sheet. Accordingly, the Ni content is preferably less than 0.15%. The Ni content is more preferably 0.14% or less, or 0.11% or less. Since Ni is not essential in the titanium alloy sheet, the lower limit of the amount thereof is 0%, but the Ni content may be, for example, 0.01% or more.

Similarly to Fe or V, Cr is an element that improves tensile strength and workability. However, when the Cr content is 0.25% or more, an intermetallic compound $TiCr_2$, which is an equilibrium phase, is generated, which may deteriorate fatigue strength and room temperature ductility of the titanium alloy sheet.

Accordingly, the Cr content is preferably less than 0.25%. The Cr content is more preferably 0.24% or less, and still more preferably 0.21% or less. Since Cr is not essential in the titanium alloy sheet, the lower limit of the amount thereof is 0%, but the Cr content may be, for example, 0.01% or more.

Similarly to Fe or V, Mn is an element that improves tensile strength and workability. However, when the Mn content is 0.25% or more, an intermetallic compound TiMn, which is an equilibrium phase, is generated, which may deteriorate fatigue strength and room temperature ductility of the titanium alloy sheet. Accordingly, the Mn content is preferably less than 0.25%. The Mn content is more preferably 0.24% or less, and still more preferably 0.20% or less. Since Mn is not essential in the titanium alloy sheet, the lower limit of the amount thereof is 0%, but the Mn content may be, for example, 0.01% or more.

Considering the effects of the chemical components mentioned above, the titanium alloy sheet according to the present embodiment preferably contains either Fe: 0.5 to 2.3% or V: 2.5 to 4.5% as an optional element.

Also, considering the effects of the chemical components mentioned above, in a case in which the titanium alloy sheet according to the present embodiment contains either Fe: 0.5 to 2.3% or V: 2.5 to 4.5%, it preferably contains one element or two or more elements selected from the group including Ni: less than 0.15%, Cr: less than 0.25%, and Mn: less than 0.25% in place of a part of Fe or V.

In a case in which the titanium alloy sheet according to the present embodiment contains Fe, when it contains one element or two or more elements selected from the group including Ni: less than 0.15%, Cr: less than 0.25%, and Mn: less than 0.25%, the total amount of Fe, Ni, Cr, and Mn is preferably 0.5% or more and 2.3% or less. If the total amount of Fe, Ni, Cr, and Mn is 0.5% or more, high tensile strength is obtained, and the β-phase having good workability at room temperature is maintained to improve workability of the titanium alloy sheet. In addition, if the total amount of Fe, Ni, Cr, and Mn is 2.3% or less, segregation of these elements is inhibited, which makes it possible to inhibit variations in properties of the titanium alloy sheet.

Also, in a case in which the titanium alloy sheet according to the present embodiment contains V, when it contains one element or two or more elements selected from the group including Ni: less than 0.15%, Cr: less than 0.25%, and Mn: less than 0.25%, the total amount of V, Ni, Cr, and Mn is preferably 2.5% or more and 4.5% or less. If the total amount of V, Ni, Cr, and Mn is 2.5% or more, high tensile strength is obtained, and the β-phase having good workability at room temperature is maintained to improve workability of the titanium alloy sheet. In addition, if the total amount of V, Ni, Cr, and Mn is 4.5% or less, segregation of these elements is inhibited, which makes it possible to inhibit variations in the properties of the titanium alloy sheet.

The titanium alloy sheet according to the present embodiment is preferably limited to C: less than 0.080%, N: 0.050% or less, and O: 0.40% or less. The content of each element is described below. In addition, since C, N, and O are not essential in the titanium alloy sheet, lower limits of their content are 0%.

When a large amount of C is contained in the titanium alloy sheet, it may reduce ductility or workability of the titanium alloy sheet. Accordingly, the C content is preferably less than 0.080%. In addition, C is an unavoidably incorporated substance and the substantial amount thereof is usually 0.0001% or more.

Similarly to C, when a large amount of N is contained in the titanium alloy sheet, it may reduce ductility or workability of the titanium alloy sheet. In addition, N is an interstitial element and penetrates into the α-phase to perform solid-solution strengthening of the titanium material, but if it is contained in a large amount, it may deteriorate cold rolling properties. Accordingly, the N content is preferably 0.050% or less. Also, N is an unavoidably incorporated substance, and the substantial amount thereof is usually 0.0001% or more.

Similarly to C, when a large amount of O is contained in the titanium alloy sheet, it may reduce ductility or workability of the titanium alloy sheet. In addition, similarly to N, O is an interstitial element and penetrates into the α-phase to perform solid-solution strengthening of the titanium material, but if it is contained in a large amount, it may deteriorate cold rolling properties. Accordingly, the O content is preferably 0.40% or less, more preferably 0.35% or less, and still more preferably 0.30% or less. Also, O is an unavoidably incorporated substance, and the substantial amount thereof is usually 0.0001% or more.

In a case in which the titanium alloy sheet according to the present embodiment contains one element or two or more elements selected from the group including O. N. Fe, and V, when the O content in % by mass is defined as [O], the N content is defined as [N], the Fe content is defined as [Fe], and the V content is defined as [V], a Q value expressed by the following formula (1) is preferably 0.340 or less. Although the lower limit of the Q value is not particularly limited, O and N are unavoidably incorporated substances, and thus the Q value is substantially greater than 0.

$$Q=[O]+(2.77\times[N])+(0.1\times[Fe])+(0.025\times[V]) \quad \text{Formula (1)}$$

The Q value is an index for estimating the cold rolling properties of the titanium material. If the Q value is more than 0.340, the cold rolling properties may be significantly lowered. As described above, when O and N are contained in a large amount, the cold rolling properties are lowered. In particular, in a system containing more than 4.0% by mass of Al, O may be ordered with Al to form an intermetallic compound, which may result in a decrease in cold rolling properties. Fe and V are β-phase stabilizing elements and basically have the effect of increasing the cold rolling properties, but when Fe and V are contained excessively, strength of the α-phase and the β-phase increases and the ductility is impaired, which may lower the cold rolling properties. Coefficients of [N], [Fe], and [V] are determined in consideration of the degree of influence on deterioration of the cold rolling properties.

The balance of the chemical composition of the titanium alloy sheet according to the present embodiment may be Ti and impurities. The impurities include, for example, H, Cl, Na, Mg, Ca, and B that are mixed in during a refining process or the like and Zr, Sn, Mo, Nb, and Ta that are mixed from scraps or the like. If the total amount of the impurities is 0.5% or less, it is a level of not causing problems. Also, the H content is 150 ppm or less. There is a risk that B may form coarse precipitates in an ingot. For that reason, even in a case in which B is contained as an impurity, it is preferable to inhibit the B content as much as possible. In the titanium alloy sheet of the present embodiment, the B content is preferably 0.01% or less.

In addition, in a case in which the titanium alloy sheet according to the present embodiment contains 0.5 to 2.3% of Fe, V contained in the titanium alloy sheet may be contained in an amount considered as an impurity, and when the titanium alloy sheet according to the present embodiment contains 2.5 to 4.5% of V, Fe contained in the titanium alloy sheet may be contained in an amount considered as an impurity.

Further, needless to say, the titanium alloy sheet according to the present embodiment may contain various elements instead of Ti as long as high strength in the sheet width direction and a high Young's modulus can be obtained. Similarly, for the elements provided as exemplary examples of impurities, if the titanium alloy sheet has high strength and excellent workability, it may contain more than the amount considered as an impurity.

As described above, the titanium alloy sheet according to the present embodiment can have the above chemical components. More specifically, the chemical composition of the titanium alloy sheet according to the present embodiment may be, for example, Ti-6Al-4V, Ti-6Al-4V ELI, or Ti-5Al-1Fe.

1.2. Metal Structure

Next, a metal structure of the titanium alloy sheet according to the present embodiment will be described.

Texture

First, a crystal orientation of a texture of the titanium alloy sheet will be described. When a titanium alloy is hot-rolled in one direction at high speed at a high temperature in a B region or an α+β high temperature region with a high proportion of the β-phase, a texture (T-texture) in which a c axis of hcp is oriented in the sheet width direction is formed during phase transformation from the β-phase to the α-phase according to variant selection rules. The T-texture is a texture formed when a non-recrystallized β-phase subjected to rolling deformation transforms into α-phase. The T-texture improves the strength and the Young's modulus in the sheet width direction. In a case in which a crystal orientation of an α-phase is expressed by an Euler angle g={φ1, Φ, φ2} according to Bunge's notation method, if the orientation with maximum intensity indicated by a crystal orientation distribution function f(g) is in the range of φ1: 0 to 30°. Φ: 60 to 90°, and φ2: 0 to 60°, and a degree of accumulation of the orientation with maximum intensity is 10.0 or more, a structure having developed T-textures is obtained. The titanium alloy sheet according to the present embodiment has the structure having developed T-textures and contains a large amount of non-recrystallized structures.

Here, the Euler angle g={φ1, Φ, φ2} according to the Bunge's notation method will be described with reference to FIG. 1. FIG. 1 is an explanatory diagram showing a crystal orientation of an α-phase crystal grain of the titanium alloy sheet by the Euler angle according to the Bunge's notation method. As a sample coordinate system, three coordinate axes of RD (a rolling direction), TD (the sheet width direction), and ND (the normal direction of a rolled surface), which are orthogonal to each other, are shown. Also, as a crystal coordinate system, three coordinate axes of an X axis, a Y axis, and a Z axis, which are orthogonal to each other, are shown. In addition, each coordinate axis is disposed such that origins of each coordinate system coincides with each other, and a hexagonal column indicating hcp is shown such that a center of a (0001) plane of hcp, which is an α-phase of titanium, coincides with the origin. In FIG. 1, the X axis coincides with the [10-10] direction of the α-phase, the Y axis coincides with the [−12-10] direction, and the Z axis coincides with the direction (c axis direction).

In the Bunge's notation method, first, a state in which the RD, TD, and ND of the sample coordinate system and the X, Y, and Z axes of the crystal coordinate system respectively coincide with each other is considered. From there, the crystal coordinate system is rotated by an angle φ1 about the Z axis, and then rotated by an angle Φ about the X axis (the state shown in FIG. 1) after the φ1 rotation. Finally, it is rotated by an angle φ2 around the Z axis after the Φ rotation. Using these three angles of φ1, Φ, and φ2, the crystal or crystal coordinate system is expressed in a particularly tilted state with respect to the sample coordinate system. That is, the crystal orientation is uniquely determined using the three angles of φ1, Φ, and φ2. These three angles of φ1, Φ, and φ2 are called Euler angles according to the Bunge's notation method. The crystal orientation (such as the c axis direction) of the α-phase crystal grain of the titanium alloy sheet is defined by the Euler angles according to the Bunge's notation method.

In FIG. 1, φ1 is an angle between a line of intersection between a RD-TD plane (a rolling plane) of the sample coordinate system and the [10-10]-[−12-10] plane of the crystal coordinate system and the RD (rolling direction) of the sample coordinate system. Φ is an angle between the ND (normal direction of the rolled surface) of the sample coordinate system and the direction (normal direction of the (0001) plane) of the crystal coordinate system. φ2 is an angle between a line of intersection between the RD-TD plane (rolling plane) of the sample coordinate system and the [10-10]-[−12-10] plane of the crystal coordinate system and the [10-10] direction of the crystal coordinate system.

Figure 2:
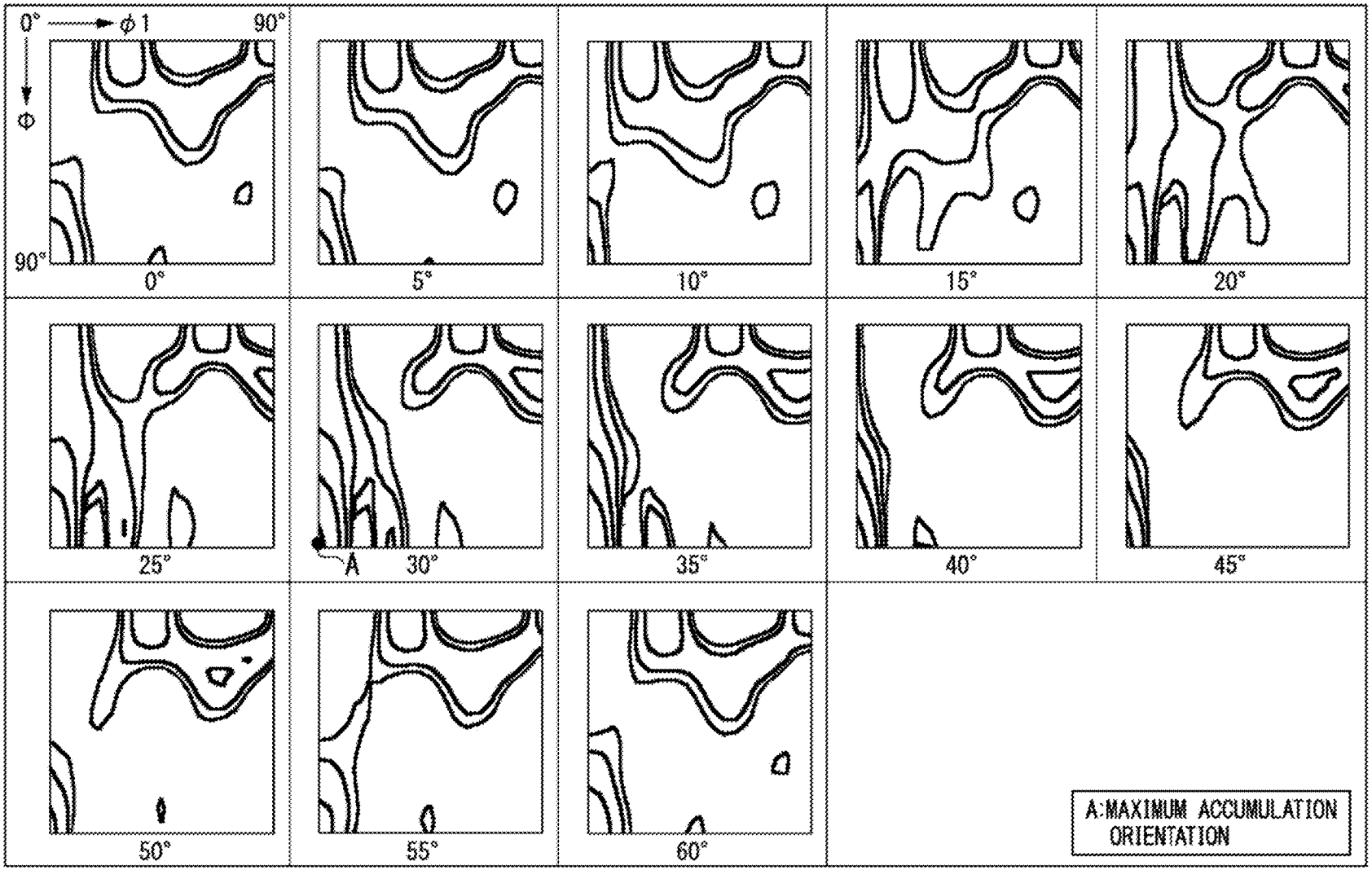
FIG. 2 is an example of a crystal orientation distribution function obtained by an electron backscatter diffraction method of a titanium alloy sheet according to an embodiment of the present disclosure.

The orientation with maximum intensity and the maximum degree of accumulation can be obtained as follows. A cross-section (an L cross-section) of the titanium alloy sheet perpendicular to the sheet width direction is chemically polished at a central position in a width direction (TD) thereof, and crystal orientation analysis is performed using an electron backscatter diffraction (EBSD) method. For each of a lower portion of a surface and a central portion of the sheet thickness of the titanium alloy sheet, a region of (total sheet thickness)×200 μm is measured in about 5 fields of view at steps of 1 μm. For the data, the crystal orientation distribution function f(g) (ODF) is calculated using OIM Analysis™ software (Ver. 8.1.0) manufactured by TSL Solutions. The crystal orientation distribution function f(g) is calculated with Series Rank of 16 and a Gaussian half width of 5° in texture analysis using a spherical harmonies method of the EBSD method. At that case, in consideration of symmetry of rolling deformation, the calculation is performed to be line symmetrical with respect to each of the sheet thickness direction, the rolling direction, and the width direction. The ODF is a function representing a three-dimensional distribution of the measured crystal orientation plotted in a three-dimensional space (Eulerian space) of φ1-Φ-Φ2 as a distribution function. FIG. 2 is an example of the crystal orientation distribution function f(g) of the titanium alloy sheet according to the present embodiment, which is obtained by an electron backscatter diffraction method. In FIG. 2, in order to display the Eulerian space in two dimensions, the Eulerian space is horizontally sliced every 5 degrees in the direction of angle φ2, and the obtained cross-sections are arranged. With this ODF, the orientation with maximum intensity and the maximum degree of accumulation can be calculated. In addition, in FIG. 2, the orientation with maximum intensity is confirmed at $\varphi1=0°$, $\Phi=90°$, and $\varphi2=30°$ (point A), and the maximum degree of accumulation is 36.3. Also, in the above description, the orientation with maximum intensity and the maximum degree of accumulation are obtained on the basis of the L cross-section at the central position in the width direction, but the texture of the titanium alloy sheet is uniform in the width direction, and thus the orientation with maximum intensity and the maximum degree of accumulation may be obtained on the basis of the L cross-section at an arbitrary sheet width position.

Dislocation Density

Metallic materials generally undergo work hardening by introducing dislocations. Also in the titanium alloy sheet, as dislocation density increases, strength increases. Since the titanium alloy sheet according to the present embodiment has the structure having a developed T-texture, it contains a large amount of non-recrystallized structures. A non-recrystallized structure is a structure in which a large amount of dislocations are introduced. As a method for estimating the dislocation density, there is a method for estimating dislocation density from a half width of a diffraction peak obtained by an X-ray diffraction (XRD) method. As the half width of a diffraction peak becomes larger, dislocation density increases. In order to obtain sufficient work hardening, a half width of a diffraction peak of a (102) plane appearing at a position of $2\theta=53.3\pm1°$ detected by X-ray diffraction using CuKα as a radiation source is preferably 0.20° or more. On the other hand, if dislocation density is too high, strength becomes too higher, notch sensitivity increases, and sheet fracture may occur. For that reason.

the half width of the diffraction peak of the (102) plane is preferably 1.00° or less, and more preferably 0.80° or less.

The dislocation density is calculated by the following method. A surface of the titanium alloy sheet is wet-polished using emery paper, and then the surface is mirror-polished using colloidal silica to obtain a mirror surface. XRD measurement is performed on the mirror-polished surface of the titanium alloy sheet. The XRD measurement is performed by using CuKα as a radiation source for the range of 2θ from 50.0° to 55.0° at a measurement pitch of 0.01" and a measurement speed of 2°/min. The half width is calculated by integrated X-ray powder diffraction software PDXL manufactured by Rigaku Corporation using X-ray diffraction data measured by SmartLab manufactured by Rigaku Corporation.

Band Structure

Figure 3:
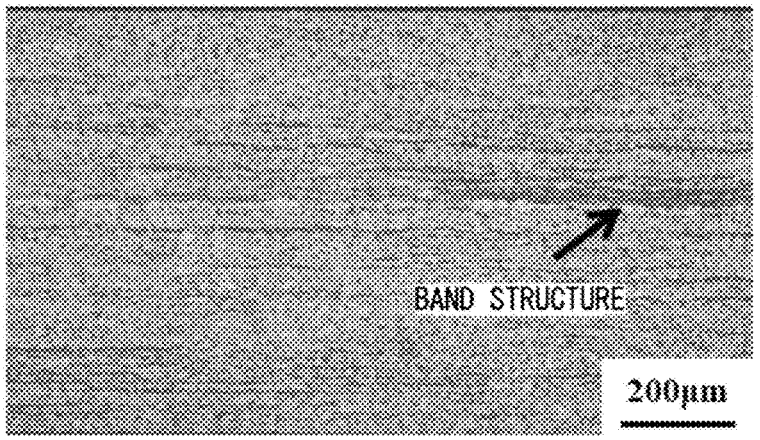
FIG. 3 is an optical microscope photograph showing an example of a band structure.
Figure 4:
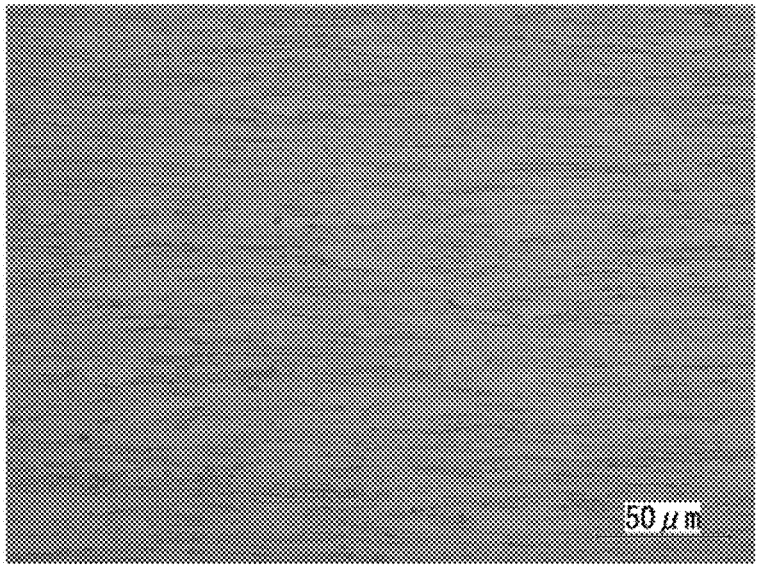
FIG. 4 is a diagram showing an example of an optical microscope photograph of the titanium alloy sheet according to the same embodiment.

The titanium alloy sheet according to the present embodiment has band structures having an aspect ratio of more than 3.0 and elongated in the sheet longitudinal direction, and the area fraction of the band structures is preferably 70% or more. The band structure mentioned here is, for example, a longitudinally elongated structure, as shown in the optical microscope photograph of a band structure in FIG. 3. Specifically, it refers to crystal grains having an aspect ratio of more than 3.0, which is expressed by the major axis/minor axis of a crystal grain. The titanium alloy sheet according to the present embodiment has band structures elongated in the sheet longitudinal direction, as shown in the optical microscope photograph of the titanium alloy sheet according to the present embodiment in FIG. 4. When a titanium alloy is hot-rolled at a temperature in the α+β region or the β region, band structures elongated in the sheet longitudinal direction are formed. The band structures have many crystal grain boundaries perpendicular to the sheet thickness direction. If the area fraction of the band structures is 70% or more, it is possible to slow down growth of cracks generated from a sheet surface in the sheet thickness direction. The area fraction of the band structures is more preferably 75% or more, and still more preferably 80% or more. Also, all crystal grains may have the band structures, and the upper limit is 100.0%.

The aspect ratios and the area fraction of the band structures can be calculated as follows. A cross-section (L cross-section) obtained by cutting the titanium alloy sheet perpendicularly to the sheet width direction at the central position of the width direction (TD) is chemically polished, a region of (total sheet thickness)×200 μm in any five fields of view in the cross-section is measured at steps of 1 μm, and crystal orientation analysis is performed by the EBSD method. From results of the crystal orientation analysis by the EBSD, aspect ratios are calculated for each crystal grain. After that, the area fraction of crystal grains having an aspect ratio exceeding 3.0 is calculated. Also, in the above, the aspect ratios and the area fraction of the band structures are calculated on the basis of the L cross-section at the central position in the width direction, but the band structures are uniformly distributed in the width direction, and thus the aspect ratios and the area ratio of the band structures may be calculated on the basis of the L cross-section at an arbitrary sheet width position.

1.3. 0.2% Proof Stress in Sheet Width Direction

A 0.2% proof stress in the sheet width direction at room temperature of the titanium alloy sheet according to the present embodiment is 800 MPa or more. In the field of aircrafts or the like, tensile strength close to the tensile strength at room temperature of Ti-6Al-4V, which is a general-purpose α+β type titanium alloy, is often required. If the titanium alloy sheet has a 0.2% proof stress of 800 MPa or more in the sheet width direction at room temperature, it can be used for applications requiring high strength. The 0.2% proof stress in the sheet width direction at room temperature is preferably 850 MPa or more. On the other hand, if strength is too high, strength of a hot-rolled sheet before cold rolling is also high, and thus the hot-rolled sheet is less likely to be cold-rolled, which may cause a plurality of passes of cold-rolling and an increase in cost. In addition, if the strength is too high, notch sensitivity increases, and thus sheet fracture may occur. Accordingly, the 0.2% proof stress in the sheet width direction at room temperature is preferably 1300 MPa or less. The 0.2% proof stress in the sheet width direction at room temperature is more preferably 1250 MPa or less. The 0.2% proof stress can be measured by a method based on JIS Z 2241: 2011. Specifically, a No. 13B tensile test piece (having a parallel part width of 12.5 mm and a gage length of 50 mm) specified in JIS Z 2241: 2011 is produced such that a tensile direction coincides with the sheet width direction of the titanium alloy sheet, and a tensile test therefor is performed at a strain rate of 0.5%/min, so that the proof stress can be measured.

1.4. Young's Modulus in Sheet Width Direction

The Young's modulus in the sheet width direction of the titanium alloy sheet according to the present embodiment is 125 GPa or more. If the Young's modulus is 125 GPa or more, it can be used in applications such as the field of aircrafts, automobile components, and consumer products, which require high rigidity. In particular, if the Young's modulus in the sheet width direction is 125 GPa or more, there is an advantage that its weight can be lightened by about 3 to 4% as compared to known techniques. Although a too high Young's modulus does not cause any problem, a practical upper limit for titanium is about 150 GPa. The Young's modulus in the sheet width direction can be measured by the following method. That is, a No. 13B tensile test piece (having a parallel part width of 12.5 mm and a gauge length of 50 mm) specified in JIS Z 2241: 2011 is produced such that a tensile direction coincides with the sheet width direction of the titanium alloy sheet, a strain gauge is attached thereto and applying-removing a load is repeated 5 times at a strain rate of 10.0%/min in a range of stress from 100 MPa to half of the 0.2% proof stress to obtain a slope thereof, and the average value of three times excluding the maximum and minimum values is set to the Young's modulus.

1.5. Vickers Hardness HV

A Vickers hardness HV of the titanium alloy sheet according to the present embodiment is 330 or higher. The Vickers hardness HV is based on JIS Z 2244: 2009, and a cross-section of the rolled sheet perpendicular to the sheet width direction (a transverse directional (TD) surface) is mirror-polished at the central position in the sheet width direction (TD) of the rolled sheet, 7 locations in the cross-section are measured with a load of 500 g and a load time of 15 seconds, and the average value of five points excluding the maximum and minimum values is set to the Vickers hardness HV. The Vickers hardness HV of the titanium alloy sheet according to the present embodiment may be 340 or higher, or 350 or higher. In addition, the Vickers hardness HV of the titanium alloy sheet according to the present embodiment may be 430 or less, or may be 420 or less. Further, the Vickers hardness HV of 330 or more in the titanium alloy sheet according to the present embodiment corresponds to a tensile strength of 1 GPa or more measured by a method based on JIS Z 2241: 2011. Also, in the above description, the TD surface at the central position in the longitudinal direction is used as a measurement surface for the Vickers hardness HV, but variations in the Vickers hardness HV of the titanium alloy sheet in the longitudinal direction are small, and thus the TD surface at any position in the longitudinal direction may be used for the measurement surface for the Vickers hardness HV.

1.6. Average Sheet Thickness

An average sheet thickness of the titanium alloy sheet according to the present embodiment is 2.5 mm or less. In the case of performing normal hot rolling, when the sheet thickness becomes thinner, a temperature drops sharply, and deformation resistance increases. Thus, in the case of hot rolling a high strength material, it may exceed an allowable load of a rolling mill, and it is difficult to reduce the average sheet thickness to 2.5 mm or less. On the other hand, although the details will be described later, the titanium alloy sheet according to the present embodiment is manufactured by a method including a cold rolling process, and thus the average sheet thickness can be set to 2.5 mm or less. In addition, there is no particular lower limit for the average sheet thickness of the titanium alloy sheet according to the present embodiment, but in reality, the titanium alloy having the above strength often has an average sheet thickness of 0.1 mm or more. For that reason, the average sheet thickness of the titanium alloy sheet according to the present embodiment is preferably 0.1 mm or more. The average sheet thickness of the titanium alloy sheet according to the present embodiment is more preferably 0.3 mm or more.

Figure 5:
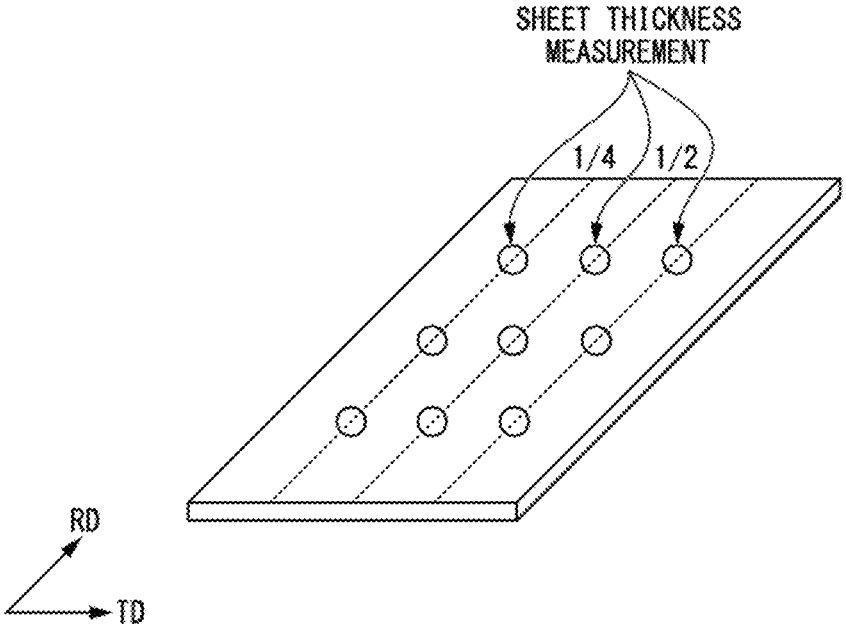
FIG. 5 is a schematic diagram showing a method for measuring an average sheet thickness.

Here, a method for measuring the average sheet thickness will be described with reference to FIG. 5. FIG. 5 is a schematic diagram showing a method for measuring the average sheet thickness. Sheet thicknesses at each of the central position in the sheet width direction (TD) and positions at a distance of ¼ of the sheet width from both ends in the sheet width direction are measured at five or more locations at intervals of 1 m or more in the longitudinal direction using X-rays, a micrometer, or a vernier caliper, and the average value of the measured sheet thicknesses is set to the average sheet thickness.

1.7. Sheet Thickness Dimensional Accuracy

Sheet thickness dimensional accuracy of the titanium alloy sheet according to the present embodiment is preferably 5.0% or less with respect to the average sheet thickness. In pack rolling, a titanium alloy sheet is manufactured by hot rolling titanium materials that are laminated in multiple layers and wrapped by steel materials, but deformation resistance of the titanium materials laminated in multiple layers varies greatly depending on a temperature distribution, and thus it is difficult to manufacture a sheet with a uniform sheet thickness. However, since the titanium alloy sheet according to the present embodiment is manufactured through the cold rolling, which will be described later, it becomes a titanium alloy sheet having excellent sheet thickness dimensional accuracy. The dimensional accuracy of the titanium alloy sheet according to the present embodiment is more preferably 4.0% or less with respect to the average sheet thickness, and still more preferably 2.0% or less.

The sheet thickness dimensional accuracy is measured by the following method. The sheet thicknesses at each of the central position in the width direction (TD) and the positions at a distance of ¼ of the sheet width from both ends in the width direction are measured at five or more locations at intervals of 1 m or more in the longitudinal direction using X-rays, a micrometer, or a vernier caliper. The maximum value of a' calculated by the following formula (101) using an actually measured sheet thickness d and the average sheet thickness dave is defined as the sheet thickness dimensional accuracy a.

$$a' = (d - \text{dave})/\text{dave} \times 100 \qquad \text{Formula (101)}$$

The titanium alloy sheet according to the present embodiment has been described above. The titanium alloy sheet according to the present embodiment described above may be manufactured by any method and can also be manufactured, for example, by the method for manufacturing a titanium alloy sheet described below.

2. Method for Manufacturing Titanium Alloy Sheet

A method for manufacturing the titanium alloy sheet according to the present embodiment includes: a slab manufacturing process of manufacturing a titanium alloy slab serving as a material (titanium material) of the titanium alloy sheet; a heating process of heating the titanium alloy slab; a hot rolling process of hot rolling the titanium alloy slab after the heating process; a cold rolling process of cold rolling the titanium material after the hot rolling process; and a temper rolling or tension levelling process of temper rolling or tension levelling the titanium material after the cold rolling process depending on needs. Each process of the method for manufacturing the titanium alloy sheet according to the present embodiment will be described below.

2.1. Slab Manufacturing Process

In the slab manufacturing process, the titanium alloy slab is manufactured. For a material thereof, a material having the chemical composition described above and manufactured by a known method can be used. The method for manufacturing the titanium alloy slab is not particularly limited, and for example, it can be manufactured according to the following procedure. For example, an ingot is produced from sponge titanium by various melting methods such as a vacuum are melting method, an electron beam melting method, a hearth melting method such as a plasma melting method, and the like. Next, the titanium alloy slab can be obtained by hot forging the obtained ingot at a temperature in a β-phase high-temperature range, an α+β two phase range, or a β-phase single phase range. In addition, the titanium alloy slab may be subjected to pretreatment such as cleaning treatment and cutting, if necessary. Also, in a case in which it is formed into a rectangular shape that can be hot-rolled by the hearth melting method, it may be subjected to hot rolling without performing hot forging or the like. The manufactured titanium alloy slab contains Al: more than 4.0% and 6.6% or less, Fe: 0% or more and 2.3% or less, V: 0% or more and 4.5% or less, Si: 0% or more and 0.60% or less, Ni: 0% or more and less than 0.15%, Cr: 0% or more and less than 0.25%. Mn: 0% or more and less than 0.25%, C: 0% or more and less than 0.080%, N: 0% or more and 0.050% or less, and O: 0% or more and less than 0.40%.

2.2. Heating Process

In the present process, the titanium alloy slab is heated to a β transformation point $T_\beta$° C. or higher and ($T_\beta$+150° C.) or lower. In a case in which the heating temperature is lower than $T_\beta$° C., the titanium alloy slab is rolled down with a high proportion of the α-phase, and the reduction with a high proportion of the β-phase becomes insufficient. For that reason, the T-texture is not sufficiently developed. In addition, when the heating temperature is more than ($T_\beta$+150° C.), the possibility of recrystallization of the β-phase during rolling becomes very high. In this case, since variant selection does not occur during the phase transformation from the β-phase to the α-phase, the T-texture is less likely to develop. Further, oxidation of a surface of the titanium alloy slab becomes severe, and scabs and scratches are likely to occur on a surface of the hot-rolled sheet after hot rolling. The temperature of the titanium alloy slab referred to here is a surface temperature, which is measured with a radiation thermometer. For the emissivity of the radiation thermometer, a value calibrated to match the temperature measured using a contact thermocouple on the slab immediately after coming out of a heating furnace is used.

Also, in the present specification, the B transformation point $T_\beta$ is a boundary temperature at which an α-phase begins to form when a titanium alloy is cooled from a β-phase single phase range. $T_\beta$ can be obtained from a phase diagram. The phase diagram can be obtained, for example, by a computer coupling of phase diagrams and thermochemistry (CALPHAD) method. Specifically, the phase diagram of the titanium alloy is obtained by the CALPHAD method using Thermo-Calc, which is an integrated thermodynamic calculation system manufactured by Thermo-Calc Software AB, and a predetermined database (TI3), so that $T_\beta$ can be calculated.

2.3. Hot Rolling Process

A titanium alloy normally forms a T-texture during transformation from a β-phase to an α-phase when it is subjected to high-speed hot rolling in one direction at a temperature on a high temperature side of a B region or an α+β region where a proportion of the β-phase is high. The T-texture can be sufficiently developed by starting hot rolling in a temperature range where a B region single phase or a β-phase fraction is high, for example, at ($T_\beta$−50)° C. or higher. Although the β transformation point differs depending on a composition of the titanium alloy slab, hot rolling is started at a temperature of 950° C. or higher, for example. In addition, in order to develop the T-texture, it is also important to perform rolling at a high rolling reduction in a temperature range with a high proportion of the β-phase to develop a texture of the β-phase and to inhibit recrystallization of the β-phase. In order to form and develop the T-texture, the method for manufacturing the titanium alloy sheet according to the present embodiment includes a hot rolling process of hot rolling the titanium alloy slab in one direction, and a rolling reduction of the titanium alloy slab in the hot rolling process is 80% or more, and a finishing temperature is ($T_\beta$−250)° C. or higher and ($T_\beta$−50)° C. or lower. Thus, the T-texture is formed in the titanium alloy hot-rolled sheet obtained by hot rolling the slab. The T-texture is excellent in cold rolling properties and is effective in increasing the strength in the sheet width direction and increasing the Young's modulus.

In a case in which the finishing temperature is lower than ($T_\beta$−250)° C., the titanium alloy slab is rolled down with a high proportion of the α-phase, and the reduction with a high proportion of the β-phase becomes insufficient. For that reason, the T-texture is not sufficiently developed. Further, when the finishing temperature is lower than ($T_\beta$−250)° C., hot deformation resistance increases sharply and hot workability deteriorates, and thus edge cracks are likely to occur and the yield is lowered.

When the finishing temperature is more than ($T_\beta$−50)° C., possibility of recrystallization of the β-phase during hot rolling becomes very high. In this case, since variant selection does not occur during the phase transformation from the β-phase to the α-phase, the T-texture is less likely to develop.

When the rolling reduction is less than 80.0%, working strain is not sufficiently introduced, the strain is not introduced uniformly over the entire sheet thickness, and the T-texture may not develop sufficiently.

In order to make the texture of the hot-rolled titanium alloy sheet be a strong T-texture and ensure high anisotropy, the titanium alloy slab is preferably heated to the above heating temperature and held for 30 minutes or longer. By holding the titanium alloy slab at the above heating temperature for 30 minutes or longer, the crystal phase of the titanium alloy slab becomes the β single phase, and the T-texture is formed and developed more easily.

Also, the heating temperature and the finishing temperature are surface temperatures of the titanium alloy slab and can be measured by known methods. The heating temperature and the finishing temperature can be measured using, for example, a radiation thermometer.

In the hot rolling process, the titanium alloy slab can be continuously hot-rolled using known continuous hot rolling equipment. In a case in which a continuous hot rolling equipment is used, the titanium alloy slab is hot-rolled and then wound by a winding machine to form a titanium alloy hot-rolled coil.

The hot-rolled titanium alloy sheet obtained through the above-described bot rolling process may be subjected, if necessary, to annealing by a known method, removal of oxide scale by pickling or cutting, washing treatment, and the like.

2.4. Cold Rolling Process

In the present process, the titanium material after the hot rolling process is subjected to one or more cold rolling passes in the longitudinal direction. The sheet thickness per cold rolling pass in the cold rolling process is 40% or less. If the rolling reduction per cold rolling pass is 40% or less, recrystallization is less likely to occur in subsequent intermediate annealing and final annealing, and the T-texture can be maintained.

Also, a cold rolling pass here indicates continuously performed cold rolling. Specifically, a cold rolling pass indicates cold rolling from after the hot rolling process until the titanium material reaches a final product thickness or from after the hot rolling process to before a temper rolling process, which will be described later, in the case of performing the temper rolling process after the hot rolling process. However, in the case of performing intermediate annealing treatment in the cold rolling process, cold rolling from after the hot rolling process to the intermediate annealing treatment and cold rolling from the intermediate annealing treatment until the titanium material reaches the final product thickness or to before the temper rolling process are respectively called a cold rolling pass. Further, in the case of performing the intermediate annealing treatment a plurality of times, cold rolling from the previous intermediate annealing treatment to the subsequent intermediate annealing treatment is also called a cold rolling pass.

A temperature at which the cold rolling pass is performed may be, for example, 500° C. or lower, or 400° C. or lower. The lower limit of the temperature at which the cold rolling pass is performed is not particularly limited, and the temperature at which the cold rolling pass is performed can be, for example, room temperature or higher. The room temperature here is intended to be 0° C. or higher.

In the cold rolling process, final annealing treatment may be performed to the titanium material after the final cold rolling pass. The final annealing treatment may be performed as appropriate and is not an essential treatment. Conditions for the intermediate annealing treatment and the final annealing treatment are such that annealing temperatures are 500° C. or higher and 750° C. or lower, and an annealing temperature T (° C.) and a holding time t (seconds) at the annealing temperature satisfy the following formula (102). In addition, $(T+273.15)\times(\mathrm{Log}_{10}(t)+20)$ in the following formula (102) is a Larson-Miller parameter.

$$18000 \leq (T+273.15)\times(\mathrm{Log}_{10}(t)+20) < 22000 \qquad \text{Formula (102)}$$

By performing the intermediate annealing treatment or the final annealing treatment under the above conditions, recrystallization is inhibited and the T-texture is maintained. In a case in which the annealing temperature is lower than 500° C. or the annealing temperature or holding time does not satisfy the above formula (102), recovery of a metal structure becomes insufficient, which may cause internal cracks or edge cracks during cold rolling, and the total amount of strain accumulation increases, which may cause recrystallization. On the other hand, when the annealing temperature is higher than 750° C., recrystallization occurs and the T-texture is lost. In the intermediate annealing process and the final annealing process, by determining the annealing temperature T and the annealing time t such that the annealing temperature is 500° C. or higher and 750° C. or lower and the annealing temperature T (° C.) and the holding time t (seconds) at the annealing temperature satisfy the following formula (102), the T-texture is maintained and internal cracks and edge cracks during cold rolling are inhibited.

2.5. Temper Rolling or Tension Levelling Process

The titanium alloy sheet is manufactured through the above cold rolling process, but the titanium alloy sheet after the cold rolling process is preferably subjected to temper rolling for adjusting mechanical properties or tension levelling for correcting its shape, if necessary. A rolling reduction in the temper rolling is preferably 10% or less, and an elongation of the titanium alloy cold-rolled sheet in the tension levelling is preferably 5% or less. Also, the temper rolling and the tension levelling may not be performed if unnecessary. The method for manufacturing the titanium alloy sheet according to the present embodiment has been described above.

According to the method for manufacturing the titanium alloy sheet according to the present embodiment, the T-texture is generated and developed through the hot rolling process, and the titanium alloy sheet in which the T-texture is maintained is obtained through the cold rolling process. Specifically, the titanium alloy sheet is obtained in which, in a case in which a crystal orientation of the α-phase is expressed by an Euler angle $g=\{\varphi1, \Phi, \varphi2\}$ according to the Bunge's notation method, the orientation with maximum intensity indicated by the crystal orientation distribution function f(g) is in the range of φ1: 0 to 30°, Φ: 60 to 90°, and φ2: 0 to 60°, and the degree of accumulation of the orientation with maximum intensity is 10.0 or more. This titanium alloy sheet contains, in % by mass. Al: more than 4.0% and 6.6% or less, Fe: 0% or more and 2.3% or less, V: 0% or more and 4.5% or less, Si: 0% or more and 0.60% or less, Ni: 0% or more and less than 0.15%, Cr: 0% or more and less than 0.25%, Mn: 0% or more and less than 0.25%, C: 0% or more and less than 0.080%, N: 0% or more and 0.050% or less, and O: 0% or more and 0.40% or less. This titanium alloy sheet has a 0.2% proof stress in the sheet width direction at 25° C. of 800 MPa or more and a Young's modulus in the sheet width direction of 125 GPa or more.

In addition, according to the method for manufacturing the titanium alloy sheet according to the present embodiment, it is possible to achieve the sheet thickness dimensional accuracy of 5.0% or less with respect to the average sheet thickness.

Further, according to the method for manufacturing the titanium alloy sheet according to the present embodiment, since rolling is performed in one direction, it is also possible to manufacture coils, and it is possible to manufacture titanium alloy sheets with high productivity.

EXAMPLES

Embodiments of the present disclosure will be specifically described below with reference to examples. Also, the examples shown below are merely examples of the present disclosure, and the present disclosure is not limited to the following examples.

Example 1

1. Manufacturing Titanium Alloy Sheet

First, a titanium alloy ingot serving as a material for titanium alloy sheets shown in Table 1 was manufactured by vacuum arc remelting (VAR), and 150 mm thick×800 mm wide×5000 mm long slabs were then manufactured by blooming or forging. Also, elements other than those listed in Table 1 are Ti and impurities. In addition, "Q" in Table 1 is a value calculated by the following formula (1).

$$Q=[O]+(2.77\times[N])+(0.1\times[Fe])+(0.025\times[V]) \quad \text{Formula (1)}$$

Further, in the formula, [O] is the O content in % by mass, [N] is the N content in % by mass, [Fe] is the Fe content in % by mass, and [V] is the V content in % by mass.

Regarding chemical components of the slabs, Al, Fe, Si, Ni, Cr, Mn, and V were measured by ICP emission spectrometry. O and N were measured by inert gas fusion, thermal conductivity and infrared absorption methods using an oxygen and nitrogen simultaneous analyzer. C was measured by an infrared absorption method using a carbon-sulfur simultaneous analyzer. Chemical compositions of each of manufactured hot-rolled sheets were the same as the chemical compositions of the titanium alloy slabs shown in Table 1. In addition, for each of the titanium materials A to P shown in Table 1, a phase diagram of a titanium alloy was obtained by the CALPHAD method using Thermo-Calc, which is an integrated thermodynamic calculation system manufactured by Thermo-Calc Software AB, and a predetermined database (TI3) to calculate the β transformation point $T_\beta$.

TABLE 1

| | Chemical components (% by mass) (the balance includes Ti and impurities.) | | | | | | | | | | |
|---|---|---|---|---|---|---|---|---|---|---|---|
| Material | Al | Fe | Si | Ni | Cr | Mn | V | C | N | O | Q |
| A | 4.8 | 1.0 | — | — | — | — | — | 0.007 | 0.009 | 0.12 | 0.245 |
| B | 5.3 | 1.1 | — | — | — | — | — | 0.008 | 0.007 | 0.18 | 0.309 |
| C | 6.1 | 1.1 | — | — | — | — | — | 0.007 | 0.005 | 0.16 | 0.284 |
| D | 5.1 | 2.0 | — | — | — | — | — | 0.005 | 0.005 | 0.15 | 0.364 |
| E | 5.2 | 1.5 | 0.25 | — | — | — | — | 0.007 | 0.008 | 0.15 | 0.322 |
| F | 4.9 | 0.9 | 0.20 | — | — | — | — | 0.008 | 0.007 | 0.13 | 0.239 |
| G | 5.3 | 0.9 | — | 0.14 | — | — | — | 0.005 | 0.007 | 0.15 | 0.259 |
| H | 4.6 | 0.7 | — | — | 0.24 | — | — | 0.006 | 0.007 | 0.15 | 0.239 |
| I | 5.1 | 0.8 | — | — | — | 0.24 | — | 0.008 | 0.008 | 0.15 | 0.252 |
| J | 5.1 | 0.8 | — | 0.11 | 0.21 | — | — | 0.007 | 0.008 | 0.17 | 0.272 |
| K | 5.1 | 1.2 | — | — | — | — | — | 0.007 | 0.008 | 0.25 | 0.392 |
| L | 5.1 | 0.9 | — | — | — | — | — | 0.007 | 0.008 | 0.35 | 0.462 |
| M | 6.2 | — | — | — | — | — | 4.1 | 0.007 | 0.008 | 0.17 | 0.295 |
| N | 4.6 | 1.0 | — | — | — | — | — | 0.005 | 0.006 | 0.06 | 0.177 |
| O | 3.0 | — | — | — | — | — | 2.5 | 0.007 | 0.008 | 0.19 | 0.275 |
| P | 5.9 | 0.2 | — | — | — | — | 2.5 | 0.007 | 0.008 | 0.17 | 0.207 |
| Q | 7.5 | 1.1 | — | — | — | — | — | 0.007 | 0.008 | 0.15 | 0.282 |

Next, hot rolling was then performed for these slabs under the conditions shown in Tables 2-1 and 2-3, and hot-rolled sheet annealing, shot blasting, and pickling were performed to obtain hot-rolled sheets with a thickness of 4 mm. The hot rolling was started at about 50° C. below the heating temperature. Subsequently, cold rolling was performed for the obtained hot-rolled sheets under the conditions shown in Tables 2-2 and 2-4. Also, in Tables 2-1 and 2-3, "$T_\beta$" is the β transformation point, and "Larson-Miller parameter" is the value of $(T+273.15)\times(\mathrm{Log}_{10}(t)+20)$.

TABLE 2-1

| | Material | | Hot rolling process | | |
|---|---|---|---|---|---|
| No | Composition | $T_\beta$ (° C.) | Heating temperature (° C.) | Finishing temperature (° C.) | Rolling reduction (%) |
| Inventive Example 1 | A | 1003 | 1050 | 887 | 95 |
| Inventive Example 2 | A | 1003 | 1050 | 887 | 95 |
| Inventive Example 3 | B | 1024 | 1100 | 901 | 95 |
| Inventive Example 4 | B | 1024 | 1100 | 901 | 95 |
| Inventive Example 5 | C | 1033 | 1100 | 913 | 95 |
| Inventive Example 6 | C | 1033 | 1100 | 913 | 95 |
| Inventive Example 7 | D | 994 | 1050 | 845 | 95 |
| Inventive Example 8 | D | 994 | 1050 | 845 | 95 |
| Inventive Example 9 | E | 1009 | 1050 | 931 | 95 |
| Inventive Example 10 | E | 1009 | 1050 | 931 | 95 |

TABLE 2-1-continued

| No | Material | | Hot rolling process | | |
|---|---|---|---|---|---|
| | Composition | $T_\beta$ (° C.) | Heating temperature (° C.) | Finishing temperature (° C.) | Rolling reduction (%) |
| Inventive Example 11 | F | 1008 | 1050 | 891 | 95 |
| Inventive Example 12 | F | 1008 | 1050 | 891 | 95 |
| Inventive Example 13 | G | 1016 | 1050 | 886 | 95 |
| Inventive Example 14 | G | 1016 | 1050 | 886 | 95 |
| Inventive Example 15 | H | 1004 | 1050 | 867 | 95 |
| Inventive Example 16 | H | 1004 | 1050 | 867 | 95 |
| Inventive Example 17 | I | 1019 | 1100 | 912 | 95 |
| Inventive Example 18 | I | 1019 | 1100 | 912 | 95 |
| Inventive Example 19 | J | 1019 | 1100 | 932 | 95 |
| Inventive Example 20 | J | 1019 | 1100 | 932 | 95 |
| Inventive Example 21 | K | 1034 | 1100 | 872 | 95 |
| Inventive Example 22 | K | 1034 | 1100 | 872 | 95 |
| Inventive Example 23 | L | 1062 | 1100 | 901 | 95 |
| Inventive Example 24 | L | 1062 | 1100 | 901 | 95 |
| Inventive Example 25 | M | 988 | 1050 | 823 | 95 |
| Inventive Example 26 | M | 988 | 1050 | 823 | 95 |
| Inventive Example 27 | N | 983 | 1050 | 892 | 95 |
| Inventive Example 28 | N | 983 | 1050 | 892 | 95 |
| Inventive Example 29 | P | 1006 | 1050 | 875 | 95 |
| Inventive Example 30 | P | 1006 | 1050 | 875 | 95 |

TABLE 2-2

| No | Cold rolling process | | | | | | | |
|---|---|---|---|---|---|---|---|---|
| | Rolling reduction per pass (%) | Number of cold rolling passes (times) | Intermediate annealing treatment | | | Final annealing treatment | | |
| | | | Annealing temperature (° C.) | Holding time (s) | Larson-Miller parameter | Annealing temperature (° C.) | Holding time (s) | Larson-Miller parameter |
| Inventive Example 1 | 30 | 2 | 650 | 120 | 20382 | 650 | 120 | 20382 |
| Inventive Example 2 | 30 | 2 | 650 | 120 | 20382 | — | — | — |
| Inventive Example 3 | 30 | 2 | 650 | 120 | 20382 | 650 | 120 | 20382 |
| Inventive Example 4 | 30 | 2 | 650 | 120 | 20382 | — | — | — |
| Inventive Example 5 | 30 | 2 | 650 | 120 | 20382 | 650 | 120 | 20382 |
| Inventive Example 6 | 30 | 2 | 650 | 120 | 20382 | — | — | — |
| Inventive Example 7 | 30 | 2 | 650 | 120 | 20382 | 650 | 120 | 20382 |
| Inventive Example 8 | 30 | 2 | 650 | 120 | 20382 | — | — | — |
| Inventive Example 9 | 30 | 2 | 650 | 120 | 20382 | 650 | 120 | 20382 |
| Inventive Example 10 | 30 | 2 | 650 | 120 | 20382 | — | — | — |
| Inventive Example 11 | 30 | 2 | 650 | 120 | 20382 | 650 | 120 | 20382 |
| Inventive Example 12 | 30 | 2 | 650 | 120 | 20382 | — | — | — |
| Inventive Example 13 | 30 | 2 | 650 | 120 | 20382 | 650 | 120 | 20382 |
| Inventive Example 14 | 30 | 2 | 650 | 120 | 20382 | — | — | — |
| Inventive Example 15 | 30 | 2 | 650 | 120 | 20382 | 650 | 120 | 20382 |
| Inventive Example 16 | 30 | 2 | 650 | 120 | 20382 | — | — | — |
| Inventive Example 17 | 30 | 2 | 650 | 120 | 20382 | 650 | 120 | 20382 |
| Inventive Example 18 | 30 | 2 | 650 | 120 | 20382 | — | — | — |
| Inventive Example 19 | 30 | 2 | 650 | 120 | 20382 | 650 | 120 | 20382 |

TABLE 2-2-continued

| | Cold rolling process | | | | | | | |
|---|---|---|---|---|---|---|---|---|
| | Rolling | Number of cold | Intermediate annealing treatment | | | Final annealing treatment | | |
| No | reduction per pass (%) | rolling passes (times) | Annealing temperature (° C.) | Holding time (s) | Larson-Miller parameter | Annealing temperature (° C.) | Holding time (s) | Larson-Miller parameter |
| Inventive Example 20 | 30 | 2 | 650 | 120 | 20382 | — | — | — |
| Inventive Example 21 | 30 | 2 | 650 | 120 | 20382 | 650 | 120 | 20382 |
| Inventive Example 22 | 30 | 2 | 650 | 120 | 20382 | — | — | — |
| Inventive Example 23 | 30 | 2 | 650 | 120 | 20382 | 650 | 120 | 20382 |
| Inventive Example 24 | 30 | 2 | 650 | 120 | 20382 | — | — | — |
| Inventive Example 25 | 30 | 2 | 650 | 120 | 20382 | 650 | 120 | 20382 |
| Inventive Example 26 | 30 | 2 | 650 | 120 | 20382 | — | — | — |
| Inventive Example 27 | 30 | 2 | 750 | 30 | 21974 | 750 | 30 | 20974 |
| Inventive Example 28 | 30 | 2 | 750 | 30 | 21974 | — | — | — |
| Inventive Example 29 | 30 | 2 | 650 | 120 | 20382 | 650 | 120 | 20382 |
| Inventive Example 30 | 30 | 2 | 650 | 120 | 20382 | — | — | — |

TABLE 2-3

| | | | Hot rolling process | | |
|---|---|---|---|---|---|
| | Material | | Heating | Finishing | Rolling |
| No | Composition | $T_\beta$ (° C.) | temperature (° C.) | temperature (° C.) | reduction (%) |
| Inventive Example 31 | A | 1003 | 1050 | 932 | 95 |
| Inventive Example 32 | A | 1003 | 1050 | 932 | 95 |
| Inventive Example 33 | A | 1003 | 1050 | 932 | 95 |
| Inventive Example 34 | A | 1003 | 1050 | 932 | 95 |
| Inventive Example 35 | A | 1003 | 1050 | 932 | 95 |
| Inventive Example 36 | A | 1003 | 1050 | 932 | 95 |
| Inventive Example 37 | A | 1003 | 1050 | 932 | 95 |
| Inventive Example 38 | A | 1003 | 1050 | 932 | 90 |
| Inventive Example 39 | A | 1003 | 1010 | 835 | 95 |
| Inventive Example 40 | A | 1003 | 1150 | 921 | 95 |
| Inventive Example 41 | A | 1003 | 1050 | 765 | 95 |
| Inventive Example 42 | A | 1003 | 1100 | 945 | 95 |
| Inventive Example 43 | A | 1003 | 1050 | 932 | 95 |
| Inventive Example 44 | A | 1003 | 1050 | 932 | 95 |
| Inventive Example 45 | A | 1003 | 1050 | 932 | 95 |
| Inventive Example 46 | A | 1003 | 1010 | 835 | 95 |
| Inventive Example 47 | A | 1003 | 1150 | 921 | 95 |
| Inventive Example 48 | A | 1003 | 1050 | 932 | 95 |
| Inventive Example 49 | A | 1003 | 1050 | 932 | 95 |
| Comparative example 1 | A | 1003 | 1200 | 950 | 95 |
| Comparative example 2 | A | 1003 | 950 | 821 | 95 |
| Comparative example 3 | A | 1003 | 1100 | 995 | 95 |
| Comparative example 4 | A | 1003 | 1050 | 732 | 95 |
| Comparative example 5 | A | 1003 | 1050 | 887 | 75 |
| Comparative example 6 | A | 1003 | 1050 | 887 | 95 |
| Comparative example 7 | A | 1003 | 1050 | 887 | 95 |
| Comparative example 8 | A | 1003 | 1050 | 887 | 95 |
| Comparative example 9 | A | 1003 | 1050 | 887 | 95 |
| Comparative example 10 | O | 947 | 1000 | 901 | 95 |
| Comparative example 11 | O | 1062 | 1100 | 947 | 95 |
| Comparative example 12 | A | 1003 | 1050 | 721 | 99 |

TABLE 2-4

| | Cold rolling process | | | | | | | |
|---|---|---|---|---|---|---|---|---|
| | Rolling | Number of cold | Intermediate appealing treatment | | | Final annealing treatment | | |
| No | reduction per pass (%) | rolling passes (times) | Annealing temperature (° C.) | Holding time (s) | Larson-Miller parameter | Annealing temperature (° C.) | Holding time (s) | Larson-Miller parameter |
| Inventive Example 31 | 40 | 2 | 650 | 120 | 20382 | 650 | 120 | 20382 |
| Inventive Example 32 | 20 | 4 | 650 | 120 | 20382 | 650 | 120 | 20382 |
| Inventive Example 33 | 30 | 2 | 750 | 30 | 21974 | 650 | 120 | 20382 |
| Inventive Example 34 | 30 | 2 | 500 | 14400 | 18678 | 650 | 120 | 20382 |
| Inventive Example 35 | 30 | 2 | 650 | 120 | 20382 | 500 | 14400 | 18678 |
| Iventive Example 36 | 30 | 2 | 650 | 120 | 20382 | 759 | 30 | 21974 |
| Inventive Example 37 | 40 | 1 | — | — | — | 650 | 120 | 20382 |
| Inventive Example 38 | 30 | 2 | 650 | 120 | 20382 | 650 | 120 | 20382 |
| Inventive Example 39 | 30 | 2 | 650 | 120 | 20382 | 654 | 120 | 20382 |
| Inventive Example 40 | 30 | 2 | 650 | 120 | 20382 | 659 | 120 | 20382 |
| Inventive Example 41 | 30 | 2 | 650 | 120 | 20382 | 650 | 120 | 20382 |
| Inventive Exangde 42 | 30 | 2 | 650 | 120 | 20382 | 650 | 120 | 20382 |
| Inventive Example 43 | 30 | 2 | 750 | 30 | 21974 | — | — | — |
| Inventive Example 44 | 30 | 2 | 650 | 120 | 20382 | — | — | — |
| Inventive Example 45 | 40 | 1 | — | — | — | — | — | — |
| Inventive Example 46 | 30 | 2 | 650 | 120 | 20382 | — | — | — |
| Inventive Example 47 | 30 | 2 | 650 | 120 | 20382 | — | — | — |
| Inventive Example 48 | 30 | 2 | 750 | 30 | 21974 | 400 | 14400 | 16262 |
| Inventive Example 49 | 30 | 2 | 650 | 120 | 20382 | 300 | 14400 | 13846 |
| Comparative example 1 | 30 | 2 | 650 | 120 | 20382 | 650 | 120 | 20382 |
| Comparative example 2 | 30 | 2 | 650 | 120 | 20382 | 650 | 120 | 20382 |
| Comparative example 3 | 30 | 2 | 650 | 120 | 20382 | 650 | 170 | 20382 |
| Comparative example 4 | 30 | 2 | 650 | 120 | 20382 | 650 | 120 | 20382 |
| Comparative example 5 | 30 | 2 | 650 | 120 | 20382 | 650 | 120 | 20382 |
| Comparative example 6 | 50 | 2 | 650 | 120 | 20382 | 650 | 120 | 20382 |
| Comparative example 7 | 30 | 2 | 450 | 28800 | 17688 | 650 | 120 | 20382 |
| Comparative example 8 | 30 | 2 | 780 | 120 | 23253 | 650 | 120 | 20382 |
| Comparative example 9 | 30 | 2 | 650 | 120 | 20382 | 780 | 120 | 23253 |
| Comparative example 10 | 30 | 2 | 650 | 120 | 20382 | 650 | 120 | 20382 |
| Comparative example 11 | Cracks occur in early cold rolling | | | | | | | |
| Comparative example 12 | Cracks occur in hot-rolled sheet and cold rolling is impossible | | | | | | | |

2. Evaluation

The following items were evaluated for the titanium alloy sheets according to each of inventive examples and comparative examples.

2.1. Texture

The orientations in which the degrees of accumulation are the maximum and the maximum degrees of accumulation of the titanium sheets according to each of inventive examples and comparative examples were measured and calculated as follows. A cross-section perpendicular to a sheet width direction of a titanium alloy sheet was chemically polished at a central position in a width direction (TD) of the titanium alloy sheet, and crystal orientation analysis was performed using EBSD. About 5 fields of view were measured in a region of (total sheet thickness)×200 μm at steps of 1 μm. For the data, OIM Analysis™ software (Ver. 8.1.0) manufactured by TSL Solutions was used to calculate the ODF, and from this ODF, a peak position of degrees of accumulation and the maximum degree of accumulation were calculated. The ODF was calculated with Series Rank of 16 and a Gaussian half width of 5° in texture analysis using a spherical harmonies method of the EBSD method. At that case, in consideration of symmetry of rolling deformation, calculation was performed to be line symmetrical in each of the thickness direction, the rolling direction, and the width direction.

2.2. Dislocation Density

There is a correlation between dislocation density and a half width of a diffraction peak detected by XRD, and thus in the present example, a half width of a diffraction peak of the (102) plane appearing at the position of $2\theta=53.3\pm1°$ detected by XRD using CuKα as a radiation source was calculated. Specifically, a surface of a titanium alloy sheet is wet-polished using emery paper, and then the surface is mirror-polished using colloidal silica to obtain a mirror surface. XRD measurement is performed on the mirror-polished surface of the titanium alloy sheet. The XRD measurement was carried out using CuKα as a radiation source, with a measurement pitch of 0.01° and a measurement speed of 2°/min in the range of 2θ from 50.0° to 55.0°. The half width was calculated by integrated X-ray powder diffraction software PDXL manufactured by Rigaku Corporation using X-ray diffraction data measured by SmartLab manufactured by Rigaku Corporation. If the half width is 0.20° or more, the dislocation density is such that sufficient work hardening can be obtained.

2.3. Area Ratio of Band Structure

A cross-section of each sample cut perpendicularly to the sheet width direction at a central position of a sheet width is chemically polished, crystal orientation analysis is performed by the EBSD method for a region of (total sheet thickness)×200 μm in the cross-section for targeting about 5 fields of view at steps of 1 μm, and aspect ratios were calculated for each crystal grain to calculate the area ratio of crystal grains having an aspect ratio exceeding 3.0.

2.4. 0.2% Proof Stress σT

The 0.2% proof stress σT in the sheet width direction at 25° C. of each of titanium alloy sheets according to inventive examples, reference examples, and comparative examples was measured based on JIS Z 2241: 2011. Specifically, a No. 13B tensile test piece (having a parallel part width of 12.5 mm and a gage length of 50 mm) specified in JIS Z 2241: 2011 was produced such that a tensile direction is a width direction of a titanium alloy sheet, and a tensile test was performed at a strain rate of 0.5%/min to measure ∝T.

2.5. Young's Modulus E in the Sheet Width Direction

A Young's modulus E in the sheet width direction of each of the titanium alloy sheets according to the inventive examples, reference examples and comparative examples was measured by the following method. That is, a No. 13B tensile test piece (having a parallel part width of 12.5 mm and a gauge length of 50 mm) specified in JIS Z 2241: 2011 was produced such that a tensile direction is a width direction of a titanium alloy sheet, a strain gauge is attached thereto, and applying-removing a load is repeated 5 times at a strain rate of 10.0%/min in a stress range from 100 MPa to half of the 0.2% proof stress to obtain a slope, and at that case, the average value of three times except for the maximum and minimum values was set to the Young's modulus.

2.6. Vickers Hardness HV

A Vickers hardness HV is based on JIS Z 2244: 2009, a cross-section perpendicular to a width direction of a rolled surface (a transverse directional (TD) surface) is mirror-polished at a central position in a longitudinal direction (RD) thereof, 7 locations in the cross-section are measured with a load of 500 g and a load time of 15 seconds, and the average value of five points excluding the maximum and minimum values was set to the Vickers hardness HV.

2.7. Average Sheet Thickness Dave

The average sheet thickness of each of the titanium alloy sheets according to the inventive examples, reference examples, and comparative examples was measured by the following method. The sheet thickness at each of a central position in the sheet width direction and positions at a distance of ¼ of a sheet width from both ends in the sheet width direction of each of the manufactured titanium alloy sheets was measured using X-rays or a vernier caliper at 5 or more locations with an interval of 1 m or more in the longitudinal direction, and the average value of the measured sheet thicknesses was set to the average sheet thickness.

2.8. Sheet Thickness Dimensional Accuracy a

The sheet thickness dimensional accuracy of the titanium alloy sheet according to each of the inventive examples, reference examples, and comparative examples is obtained such that, using a sheet thickness d actually measured by the above method and the average sheet thickness dave, the maximum value of a' calculated by the following formula (101) was defined as the dimensional accuracy a.

$$a'=(d-\text{dave})/\text{dave}\times100 \quad \text{Formula (101)}$$

2.9. Cold Rolling Properties

The cold rolling properties of each of the titanium alloy sheets according to the inventive examples, reference examples, and comparative examples were evaluated by the following method. That is, the maximum value of edge cracks after cold rolling was evaluated. Then, in a case in which the maximum value of edge cracks after cold rolling is 1 mm or less, the cold rolling properties were rated as being extremely good "A," in a case in which the maximum value of edge cracks after cold rolling is more than 1 mm and 2 mm or less, the cold rolling properties were rated as being good "B," and in a case in which the maximum value of edge cracks after cold rolling was more than 2 mm, the cold rolling properties were rated as being poor "C."

3. Results

The above evaluation results are shown in Tables 3-1 and 3-2. Also, "φ1," "Φ," and "φ2" in Table 3 are angles based on the Bunge's notation method.

TABLE 3-1

| | Sheet thickness (mm) | | Metal structure | | | | | | | | | |
|---|---|---|---|---|---|---|---|---|---|---|---|---|
| | Average sheet thickness dave (mm) | Dimensional accuracy a (%) | Texture: Maximum degree of accumulation | φ1 (°) | Φ (°) | φ2 (°) | Half width (°) | Area ratio of band structure (%) | Tensile properties: σT (Mpa) | E (GPa) | Cold rolling properties | Vickers hardness HV |
| Inventive Example 1 | 1.6 | 2.4 | 33.2 | 0 | 90 | 30 | 0.39 | 93 | 908 | 131 | A | 355 |
| Inventive Example 2 | 1.6 | 1.5 | 36.3 | 0 | 90 | 30 | 0.49 | 100 | 931 | 127 | A | 361 |
| Inventive Example 3 | 1.6 | 2.6 | 29.3 | 0 | 90 | 30 | 0.41 | 95 | 927 | 131 | A | 358 |
| Inventive Example 4 | 1.6 | 2.7 | 30.4 | 0 | 90 | 30 | 0.51 | 100 | 949 | 130 | A | 367 |
| Inventive Example 5 | 1.6 | 2.1 | 34.1 | 0 | 90 | 30 | 0.38 | 91 | 962 | 134 | A | 371 |
| Inventive Example 6 | 1.6 | 2.0 | 33.6 | 0 | 90 | 30 | 0.47 | 100 | 982 | 131 | A | 384 |
| Inventive Example 7 | 1.6 | 2.0 | 31.2 | 0 | 90 | 30 | 0.36 | 89 | 951 | 130 | B | 367 |
| Inventive Example 8 | 1.6 | 2.2 | 30.5 | 0 | 90 | 30 | 0.45 | 100 | 973 | 126 | B | 380 |
| Inventive Example 9 | 1.6 | 2.3 | 36.5 | 0 | 90 | 30 | 0.37 | 93 | 1091 | 130 | A | 420 |
| Inventive Example 10 | 1.6 | 2.1 | 39.4 | 0 | 90 | 30 | 0.45 | 100 | 1118 | 128 | A | 430 |
| Inventive Example 11 | 1.6 | 1.8 | 29.3 | 0 | 90 | 30 | 0.39 | 94 | 1060 | 132 | A | 414 |
| Inventive Example 12 | 1.6 | 1.8 | 27.7 | 0 | 90 | 30 | 0.50 | 100 | 1084 | 128 | A | 423 |
| Inventive Example 13 | 1.6 | 1.9 | 29.4 | 0 | 90 | 30 | 0.36 | 87 | 951 | 131 | A | 369 |
| Inventive Example 14 | 1.6 | 1.9 | 31.2 | 0 | 90 | 30 | 0.44 | 100 | 979 | 127 | A | 376 |
| Inventive Example 15 | 1.6 | 1.9 | 31.2 | 0 | 90 | 30 | 0.34 | 96 | 945 | 131 | A | 362 |
| Inventive Example 16 | 1.6 | 2.1 | 30.6 | 0 | 90 | 30 | 0.46 | 100 | 969 | 129 | A | 379 |
| Inventive Example 17 | 1.6 | 2.2 | 32.5 | 0 | 90 | 30 | 0.35 | 91 | 930 | 130 | A | 358 |
| Inventive Example 18 | 1.6 | 2.2 | 32.4 | 0 | 90 | 30 | 0.46 | 100 | 935 | 127 | A | 372 |
| Inventive Example 19 | 1.6 | 1.5 | 36.1 | 0 | 90 | 30 | 0.35 | 93 | 940 | 130 | A | 364 |
| Inventive Example 20 | 1.6 | 1.7 | 37.7 | 0 | 90 | 30 | 0.43 | 100 | 968 | 129 | A | 379 |
| Inventive Example 21 | 1.6 | 2.3 | 34.3 | 0 | 90 | 30 | 0.38 | 94 | 999 | 133 | B | 384 |
| Inventive Example 22 | 1.6 | 2.5 | 35.6 | 0 | 90 | 30 | 0.48 | 100 | 1022 | 131 | B | 393 |
| Inventive Example 23 | 1.6 | 1.8 | 33.1 | 0 | 90 | 30 | 0.37 | 91 | 1072 | 136 | B | 417 |
| Inventive Example 24 | 1.6 | 1.8 | 31.1 | 0 | 90 | 30 | 0.48 | 100 | 1098 | 134 | B | 475 |
| Inventive Example 25 | 1.6 | 1.5 | 32.5 | 0 | 90 | 30 | 0.39 | 98 | 1071 | 135 | A | 417 |
| Inventive Example 26 | 1.6 | 1.4 | 29.9 | 0 | 90 | 30 | 0.50 | 100 | 1100 | 133 | A | 426 |
| Inventive Example 27 | 1.6 | 2.7 | 31.2 | 0 | 90 | 30 | 0.18 | 69 | 823 | 126 | A | 335 |
| Inventive Example 28 | 1.6 | 2.6 | 30.0 | 0 | 90 | 30 | 0.46 | 100 | 846 | 125 | A | 339 |
| Inventive Example 29 | 1.6 | 2.2 | 28.3 | 0 | 90 | 30 | 0.37 | 97 | 910 | 130 | A | 351 |

TABLE 3-1-continued

| | Sheet thickness (mm) | | Metal structure | | | | | | | | | |
|---|---|---|---|---|---|---|---|---|---|---|---|---|
| | Average sheet thickness dave (mm) | Dimensional accuracy a (%) | Texture Maximum degree of accumulation | φ1 (°) | Φ (°) | φ2 (°) | Half width (°) | Area ratio of band structure (%) | Tensile properties σT (Mpa) | E (GPa) | Cold rolling properties | Vickers hardness HV |
| Inventive Example 30 | 1.6 | 2.1 | 30.2 | 0 | 90 | 30 | 0.47 | 100 | 932 | 128 | A | 361 |

TABLE 3-2

| | Sheet thickness (mm) | | Metal structure | | | | | | | | | |
|---|---|---|---|---|---|---|---|---|---|---|---|---|
| No | Average sheet thickness dave (mm) | Dimensional accuracy a (%) | Texture Maximum degree of accumulation | φ1 (°) | Φ (°) | φ2 (°) | Half width (°) | Area ratio of band structure (%) | Tensile properties σT (Mpa) | E (GPa) | Cold rolling properties | Vickers hardness HV |
| Inventive Example 31 | 1.2 | 4.1 | 27.9 | 0 | 75 | 30 | 0.27 | 95 | 899 | 128 | A | 350 |
| Inventive Example 32 | 1.3 | 3.5 | 26.4 | 0 | 80 | 30 | 0.31 | 91 | 910 | 132 | A | 349 |
| Inventive Example 33 | 1.6 | 2.1 | 23.0 | 0 | 90 | 30 | 0.38 | 90 | 886 | 131 | A | 344 |
| Inventive Example 34 | 1.6 | 1.7 | 34.6 | 0 | 90 | 30 | 0.34 | 84 | 906 | 131 | A | 349 |
| Inventive Example 35 | 1.6 | 2.6 | 21.3 | 0 | 90 | 30 | 0.29 | 94 | 879 | 130 | A | 342 |
| Inventive Example 36 | 1.6 | 2.4 | 30.1 | 0 | 90 | 30 | 0.39 | 68 | 919 | 129 | B | 358 |
| Inventive Example 37 | 1.9 | 1.2 | 35.1 | 0 | 90 | 30 | 0.34 | 91 | 902 | 132 | B | 355 |
| Inventive Example 38 | 1.6 | 1.7 | 13.0 | 0 | 90 | 30 | 0.27 | 92 | 881 | 128 | A | 342 |
| Inventive Example 39 | 1.6 | 1.8 | 14.3 | 0 | 90 | 30 | 0.36 | 76 | 897 | 129 | A | 350 |
| Inventive Example 40 | 1.6 | 2.4 | 12.5 | 0 | 90 | 30 | 0.34 | 92 | 905 | 132 | A | 356 |
| Inventive Example 41 | 1.6 | 1.9 | 13.5 | 0 | 90 | 30 | 0.28 | 73 | 861 | 126 | A | 335 |
| Inventive Example 42 | 1.6 | 2.3 | 11.3 | 0 | 90 | 30 | 0.35 | 86 | 872 | 127 | A | 336 |
| Inventive Example 43 | 1.6 | 2.0 | 23.4 | 0 | 90 | 30 | 0.50 | 100 | 913 | 120 | A | 351 |
| Inventive Example 44 | 1.6 | 2.6 | 20.9 | 0 | 90 | 30 | 0.38 | 100 | 905 | 130 | A | 350 |
| Inventive Example 45 | 1.9 | 1.0 | 34.3 | 0 | 90 | 30 | 0.43 | 100 | 929 | 128 | B | 361 |
| Inventive Example 46 | 1.6 | 2.0 | 17.1 | 0 | 90 | 30 | 0.47 | 100 | 924 | 120 | A | 359 |
| Inventive Example 47 | 1.6 | 2.5 | 11.0 | 0 | 90 | 30 | 0.44 | 100 | 933 | 128 | A | 364 |
| Inventive Example 48 | 1.6 | 2.2 | 23.4 | 0 | 90 | 30 | 0.47 | 100 | 905 | 128 | A | 356 |
| Inventive Example 49 | 1.6 | 2.4 | 21.8 | 0 | 90 | 30 | 0.37 | 100 | 902 | 130 | A | 348 |
| Comparative example 1 | 1.6 | 2.1 | 8.2 | 0 | 90 | 30 | 0.29 | 91 | 841 | 122 | A | 323 |
| Comparative example 2 | 1.6 | 1.7 | 12.3 | 0 | 0 | 30 | 0.31 | 72 | 834 | 123 | A | 322 |
| Comparative example 3 | 1.6 | 2.0 | 7.6 | 0 | 90 | 30 | 0.34 | 87 | 837 | 123 | A | 323 |
| Comparative example 4 | 1.6 | 1.6 | 13.8 | 0 | 0 | 30 | 0.37 | 76 | 810 | 116 | A | 319 |
| Comparative example 5 | 1.6 | 2.2 | 9.4 | 0 | 90 | 30 | 0.36 | 84 | 875 | 124 | A | 345 |

TABLE 3-2-continued

| | Sheet thickness (mm) | | Metal structure | | | | | | | | | |
|---|---|---|---|---|---|---|---|---|---|---|---|---|
| | Average sheet thickness | Dimensional | Texture | | | | | Area ratio of band | Tensile properties | | Cold | Vickers |
| No | dave (mm) | accuracy a (%) | Maximum degree of accumulation | φ1 (°) | Φ (°) | φ2 (°) | Half width (°) | structure (%) | σT (Mpa) | E (GPa) | rolling properties | hardness HV |
| Comparative example 6 | 0.8 | 4.8 | 15.3 | 0 | 45 | 30 | 0.19 | 67 | 832 | 118 | C | 324 |
| Comparative example 7 | 1.6 | 1.9 | 13.4 | 0 | 45 | 30 | 0.23 | 61 | 836 | 117 | C | 325 |
| Comparative example 8 | 1.6 | 2.1 | 19.4 | 0 | 45 | 30 | 0.48 | 61 | 832 | 119 | A | 321 |
| Comparative example 9 | 1.6 | 2.2 | 20.3 | 0 | 45 | 30 | 0.07 | 0 | 840 | 118 | A | 323 |
| Comparative example 10 | 1.6 | 2.1 | 21.5 | 0 | 90 | 30 | 0.32 | 99 | 692 | 122 | A | 272 |
| Comparative example 11 | Unable to evaluate | | | | | | | | | | | |
| Comparative example 12 | Unable to evaluate | | | | | | | | | | | |

Also in all of Inventive Examples 1 to 49, the orientation with maximum intensity was in the range of φ1: 0 to 30°, Φ: 60 to 90°, and φ2: 0 to 60°, and the maximum degree of accumulation was 10.0 or more. In addition, in Inventive Examples 1 to 26, 28 to 35, and 37 to 49, the half width was 0.20° or more, and the area ratio of the band structures was 70% or more. Farther, also in all of Inventive Examples 1 to 49, the 0.2% proof stress σT in the sheet width direction at 25° C. was 800 MPa or more, and the Young's modulus in the sheet width direction was 125 GPa or more. The final average sheet thickness dave was 1.2 to 1.9 mm, and the dimensional accuracy a was 5.0% or less. In Comparative example 10, since the Al content was small, the 0.2% proof stress was as small as 692 MPa, and the Young's modulus in the sheet width direction was as small as 122 GPa. Comparative example 11 had a high Al content, and surface cracks and severe edge cracks occurred during cold rolling after hot rolling. In Comparative example 12, the temperature dropped significantly in the second half of hot rolling, and the hot-rolled sheet broke, and thus a sheet with a thickness of 2.5 mm could not be manufactured.

Inventive Examples 1 to 6, 9 to 20, and 25 to 49 have a Q value of 0.340 or less, and these inventive examples exhibited good cold rolling properties as compared to Inventive Examples 7, 8, and 21 to 24 with a Q value of more than 0.340.

On the other hand, Comparative examples 1 to 10 deviated from the manufacturing conditions of the method for manufacturing the titanium alloy sheet according to the present disclosure, in which the orientation with maximum intensity or the degree of accumulation of the orientation with maximum intensity did not satisfy the requirements defined in the present application, and the Young's modulus E in the sheet width direction was less than 125 GPa.

Although the preferred embodiments of the present disclosure have been described in detail above, the present disclosure is not limited to such examples. It is obvious that a person having ordinary knowledge in the technical field to which the present disclosure belongs could conceive various changes or modifications within the scope of the technical idea described in the claims and it is naturally understood that these also fall within the technical scope of the present disclosure.

What is claimed is:

1. A titanium alloy sheet containing, in % by mass:

Al: more than 4.0% and 6.6% or less,

Fe: 0% or more and 2.3% or less,

V: 0% or more and 4.5% or less,

Si: 0% or more and 0.60% or less,

Ni: 0% or more and less than 0.15%,

Cr: 0% or more and less than 0.25%,

Mn: 0% or more and less than 0.25%,

C: 0% or more and less than 0.080%,

N: 0% or more and 0.050% or less,

O: 0% or more and 0.40% or less, and a remainder of Ti and impurities, wherein, in a case in which a crystal orientation of an α-phase is expressed by an Euler angle g={φ1, ϕ, φ2} according to Bunge's notation method, the orientation with maximum intensity indicated by a crystal orientation distribution function f(g) calculated with Series Rank of 16 and a Gaussian half width of 5° in texture analysis using a spherical harmonics method of an electron backscatter diffraction method is in the range of φ1: 0 to 30°, ϕ: 60 to 90°, and φ2: 0 to 60°, and a degree of accumulation of the orientation with maximum intensity is 10.0 or more, a 0.2% proof stress in a sheet width direction at 25° C. is 800 MPa or more, a Young's modulus in the sheet width direction is 125 GPa or more, and an average sheet thickness is 2.5 mm or less.

2. The titanium alloy sheet according to claim 1 containing, in % by mass, either Fe: 0.5% or more and 2.3% or less or V: 2.5% or more and 4.5% or less.

3. The titanium alloy sheet according to claim 2, wherein, in a case in which one element or two or more elements selected from the group including O, N, Fe, and V are contained in place of a part of the Ti, when the O content, in % by mass, is defined as [O], the N content is defined as [N], the Fe content is defined as [Fe], and the V content is defined as [V], Q expressed by the following formula (1) is 0.340 or less $$Q=[O]+(2.77\times[N])+(0.1\times[Fe])+(0.025\times[V]) \quad \text{Formula (1).}$$

4. The titanium alloy sheet according to claim 2 containing, in % by mass, one element or two or more elements selected from the group including Ni: less than 0.15%, Cr: less than 0.25%, and Mn: less than 0.25% in place of a part of the Fe or the V.

5. The titanium alloy sheet according to claim 4, wherein, in a case in which one element or two or more elements selected from the group including O, N, Fe, and V are contained in place of a part of the Ti, when the O content, in % by mass, is defined as [O], the N content is defined as [N], the Fe content is defined as [Fe], and the V content is defined as [V], Q expressed by the following formula (1) is 0.340 or less $$Q=[O]+(2.77\times[N])+(0.1\times[Fe])+(0.025\times[V]) \quad \text{Formula (1).}$$

6. The titanium alloy sheet according to claim 1, wherein a half width of a diffraction peak at $2\theta=53.3\pm1°$ detected by an X-ray diffraction method using CuKα as a radiation source is 0.20° or more.

7. The titanium alloy sheet according to claim 1 including band structures having an aspect ratio of more than 3.0 and elongated in a sheet longitudinal direction, wherein an area fraction of the band structures is 70% or more.

8. The titanium alloy sheet according to claim 1, wherein a dimensional accuracy of a sheet thickness thereof is 5.0% or less with respect to the average sheet thickness.

9. A method for manufacturing a titanium alloy sheet containing, in % by mass:

Al: more than 4.0% and 6.6% or less,
Fe: 0% or more a 1.3% or less,
V: 0% or more and 14.5% or less,
Si: 0% or more and 0.60% or less,
Ni: 0% or more and less than 0.15%,
Cr: 0% or more and less than 0.25%,
Mn: 0% or more and less than 0.25%,
C: 0% or more and less than 0.080%,
N: 0% or more and 0.050% or less,
O: 0% or more and 0.40% or less, and
a remained of Ti and impurities, wherein, in a case in which a crystal orientation of an α-phase is expressed by an Euler angle $g=\{\varphi1, \phi, \varphi2\}$ according to Bunge's notation method, the orientation with maximum intensity indicated by a crystal orientation distribution function f(g) calculated with Series Rank of 16 and a Gaussian half width of 5° in texture analysis using a spherical harmonics method of an electron backscatter diffraction method is in the range of φ1: 0 to 30°, ϕ: 60 to 90°, and φ2: 0 to 60°, and a degree of accumulation of the orientation with maximum intensity is 10.0 or more, a 0.2% proof stress in a sheet width direction at 25° C. is 800 MPa or more, a Young's modulus in the sheet width direction is 125 GPa or more, and an average sheet thickness is 2.5 mm or less, the method comprising:

heating a titanium material containing, in % by mass, Al: more than 4.0% and 6.6% or less, Fe: 0% or more and 2.3% or less, V: 0% or more and 4.5% or less, Si: 0% or more and 0.60% or less, Ni: 0% or more and less than 0.15%, Cr: 0% or more and less than 0.25%, Mn: 0% or more and less than 0.25%, C: 0% or more and less than 0.08%, N: 0% or more and 0.05% or less, O: 0% or more and 0.40% or less, and a remainder of Ti and impurities;

hot rolling the titanium material in one direction after the heating; and performing one or more cold rolling passes on the titanium material after the hot rolling in a longitudinal direction of the titanium material, wherein, when a β transformation point is defined as $T_\beta$ (° C.), a heating temperature of the titanium material in the heating is $T_\beta$° C. or higher and ($T_\beta$+150° C.) or lower, a rolling reduction in the hot rolling is 80.0% or more, a finishing temperature in the hot rolling is ($T_\beta$−250° C.) or higher and ($T_\beta$−50° C.) or lower, in the cold rolling, a rolling reduction per cold rolling pass is 40% or less, and in the case of performing a plurality of cold rolling passes, intermediate annealing treatment is included, in annealing conditions for the intermediate annealing treatment, an annealing temperature is 500° C. or higher and 750° C. or lower, and the annealing temperature T (° C.) and a holding time t (seconds) at the annealing temperature satisfy the following formula (2)

$$18000\leq(T+273.15)\times(\mathrm{Log}_{10}(t)+20)<22000 \quad \text{Formula (2).}$$

10. The method for manufacturing the titanium alloy sheet according to claim 9, wherein, after the final cold rolling pass, final annealing in which the annealing temperature is 500° C. or higher and 750° C. or lower and which satisfies the above formula (2) is performed.

* * * * *